US008525430B2

(12) United States Patent
Brockett et al.

(10) Patent No.: US 8,525,430 B2
(45) Date of Patent: Sep. 3, 2013

(54) HELICAL STRUCTURE AND METHOD FOR PLASMA LAMP

(75) Inventors: Timothy J. Brockett, Canoga Park, CA (US); David P. Schmelzer, Santa Monica, CA (US); Mehran Matloubian, Encino, CA (US); Frederick M. Espiau, Topanga, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 528 days.

(21) Appl. No.: 12/794,462

(22) Filed: Jun. 4, 2010

(65) Prior Publication Data

US 2010/0308726 A1 Dec. 9, 2010

Related U.S. Application Data

(60) Provisional application No. 61/185,556, filed on Jun. 9, 2009.

(51) Int. Cl.
*H05B 41/16* (2006.01)

(52) U.S. Cl.
USPC ..... 315/248; 315/267; 315/283; 315/284

(58) Field of Classification Search
USPC ..... 315/46–75, 248, 283, 284, 285; 313/515–522, 110–116, 146–160
See application file for complete search history.

(56) References Cited

U.S. PATENT DOCUMENTS

| | | | | |
|---|---|---|---|---|
| 3,619,699 | A | 11/1971 | White | |
| 5,866,991 | A * | 2/1999 | Farkas et al. | 315/248 |
| 6,949,887 | B2 | 9/2005 | Kirkpatrick | |
| 7,193,375 | B2 | 3/2007 | Rudolph | |

OTHER PUBLICATIONS

Notification Concerning Transmittal of International Preliminary Report on Patentability (Chapter 1 of the Patent Cooperation Treaty) of PCT Application No. PCT/US2010/038039, dated Dec. 22, 2011, 8 pages total.

International Search Report and Written Opinion of PCT Application No. PCT/US10/038037, dated Aug. 19, 2010, 9 pages.

* cited by examiner

*Primary Examiner* — Tuyet Thi Vo

(74) *Attorney, Agent, or Firm* — Kilpatrick Townsend & Stockton LLP

(57) ABSTRACT

A plasma lamp apparatus includes a post structure with a material overlying a surface region of the post structure, which has a first end and a second end. The apparatus also has a helical coil structure configured along the post structure. The apparatus includes a bulb with a fill material capable of emitting electromagnetic radiation. A resonator coupling element configured to feed radio frequency energy to at least the helical coil causes the bulb device to emit electromagnetic radiation.

20 Claims, 22 Drawing Sheets

HELICAL STRUCTURE AND METHOD FOR PLASMA LAMP

CROSS-REFERENCE TO RELATED APPLICATION

This application claims priority from provisional patent application Ser. No. 61/185,556, filed Jun. 9, 2009, entitled Helical Structure and Method for Plasma Lamp, which is incorporated by reference herein for all purposes.

BACKGROUND OF THE INVENTION

This invention relates to lighting techniques. In particular, the invention provides a method and device using a plasma lighting device having a shaped resonator assembly including a helical or coil structure, which is coupled to a radio frequency source. Such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, and similar uses.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800, Thomas Edison, who is one of the greatest inventors of all time, conceived the incandescent lamp, which uses a tungsten filament within a bulb, coupled to a pair of electrodes. Many conventional buildings and homes still use the incandescent lamp, commonly called the Edison bulb. Although highly successful, the Edison bulb consumed much energy and was generally inefficient.

Fluorescent lighting has replaced incandescent lamps for certain applications. Fluorescent lamps generally consist of a tube containing a gaseous material, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode, which is a solid state lamp. The blue light emitting diode forms a basis for the white solid state light, which is often a blue light emitting diode within a bulb coated with a yellow phosphor material. Blue light excites the phosphor material to emit white light. The blue light emitting diode has revolutionized the lighting industry to replace traditional lighting for homes, buildings, and other structures.

Another form of lighting is commonly called the electrodeless lamp, which can be used to discharge light for high intensity applications. Frederick M. Espiau was one of the pioneers that developed an improved electrodeless lamp. Such electrodeless lamp relied upon a solid ceramic resonator structure, which was coupled to a fill enclosed in a bulb. The dielectric resonator (dielectric waveguide) coupled the RF energy from an RF source to the bulb fill to cause it to discharge high intensity lighting. Although somewhat successful, the electrodeless lamp still had many limitations. The dielectric material (such as Alumina) used for the dielectric resonator/waveguide must have low losses at RF frequencies resulting in higher material cost. Furthermore, the dielectric resonator/waveguide is difficult to manufacture resulting in an expensive lamp. As an example, electrodeless lamps have not been successfully deployed in high volume for general lighting applications. Additionally, electrodeless lamps are generally difficult to disassemble and assembly leading to inefficient use of such lamps. These and other limitations may be described throughout the present specification and more particularly below.

From the above, it is seen that improved techniques for lighting are highly desired.

BRIEF SUMMARY OF THE INVENTION

According to the present invention, techniques for lighting are provided. In particular, the present invention provides a method and device using an electrodeless plasma lighting device having a shaped resonator assembly including a helical or coil structure, which is coupled to a radio frequency source. Such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

In a specific embodiment, the present invention provides a plasma lamp apparatus. The apparatus includes a post structure comprising a material overlying a surface region of the post structure, which has a first end and a second end. The apparatus also has a helical coil structure operably configured along one or more portions of the post structure according to a specific embodiment. In a preferred embodiment, the helical coil acts as an inductive coupling structure and also facilitates thermal energy transport. The apparatus has a bulb device configured to the first end of the post structure, which is coupled to the helical coil structure. In a preferred embodiment, the bulb device comprises a gas filled vessel that is filled with an inert gas such as Argon and a fluorophor or light emitter such as Mercury, Sodium, Dysprosium, Sulfur or a metal halide salt such as Indium Bromide, Scandium Bromide, or Cesium Iodide (or it can simultaneously contain multiple fluorophors or light emitters). The gas filled vessel can also include a metal halide, or other metal pieces that will discharge electromagnetic radiation according to a specific embodiment. The device has a resonator coupling element configured to feed radio frequency energy to at least the helical coil structure and to cause the bulb device to emit electromagnetic radiation. In a specific embodiment, the radio frequency energy has a frequency ranging from 1000 MHz to less than about 8 MHz, but can be others. As used herein, the terms "first" and "second" are not intended to imply order and should be interpreted by ordinary meaning. Additionally, such terms may be defined by at least the descriptions provided in the specification as well as by meanings consistent with one of ordinary skill in the art.

In an alternate embodiment of the present invention, a method for lowering the resonant frequency and improving the heat transfer characteristics of the device is created. The method includes creating a helical shaped RF output coupling-element that is either wrapped around a dielectric material, or simply coiled through air. The presence of a dielectric medium within the helical shaped RF output coupling-element serves to more efficiently absorb thermal energy that is generated by the bulb and subsequently transferred through the RF output coupling-element and the dielectric material. In creating a helical shaped RF output coupling element, the inductance of the resonant structure is increased leading to lower resonant frequencies at which the device operates at without substantially changing the size of the resonant structure. In lowering the operational resonant frequency, amplifiers with higher efficiencies can be used to operate the lamp. Alternatively the lower frequency resonator can be used to couple RF energy to larger bulbs and in conjunction with higher power amplifiers, higher lumens output lamps can be realized. Adding a dielectric material within the helical shaped RF output coupling element, helps in transferring the heat from the bulb to the resonator/lamp body.

Still further, the present invention provides an apparatus for a plasma lamp. The apparatus includes a gas filled vessel. The apparatus also includes a first coil structure comprising a first end and a second end. Preferably, the first end is coupled to the gas filled vessel. The apparatus also includes a second coil structure, which is coupled with one or more portions of the first coil structure.

Moreover, the present invention provides an alternative plasma lamp apparatus. The apparatus has a support structure having a first end and a second end and a coil structure configured along one or more portions of the support structure according to a specific embodiment. The apparatus also has a bulb device configured to the first end of the support structure according to a specific embodiment. The apparatus has a ground potential coupled to the second end of the support structure and a coupling element configured to feed at least radio frequency energy to at least the coil structure and to cause the bulb device to emit electromagnetic radiation. Still further, the present invention provides a method of improving heat transfer of an electrode-less plasma lamp according to an alternative embodiment. The method includes using a helical shaped element to draw thermal energy from a plasma lamp to a thermal sink region in a specific embodiment.

Benefits are achieved over pre-existing techniques using the present invention. In a specific embodiment, the present invention provides a method and device having configurations of input, output, and feedback coupling elements that provide for electromagnetic coupling to the bulb whose power transfer and frequency resonance characteristics that are largely independent of the conventional dielectric resonator, but can also be dependent upon conventional designs. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods for street lighting applications. Still further, the present method and device provide for improved heat transfer characteristics, as well as further simplifying manufacturing and/or retrofitting of existing and new street lighting, such as lamps, and the like. In a specific embodiment, the present method and resulting structure are relatively simple and cost effective to manufacture for commercial applications. In a specific embodiment, the present invention includes a helical resonator structure, which increases inductance and therefore reduces the resonating frequency of a device. In a preferred embodiment, the resonating frequency may be about 250 MHz and less or about 100 MHz and less depending upon the type of coil, number of windings, and other parameters. In a specific embodiment, the present method and lamp device has a substantially exposed arc, in contrast to conventional plasma lamps where the arc of the bulb is substantially surrounded by the dielectric resonator/waveguide limiting the ability of the lamp to be used with typical luminaries. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

DETAILED DESCRIPTION OF THE INVENTION

According to the present invention, techniques for lighting are provided. In particular, the present invention provides a method and device using a plasma lighting device having a shaped resonator assembly including a helical or coil structure, which is coupled to a radio frequency source. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

Figure 1A:
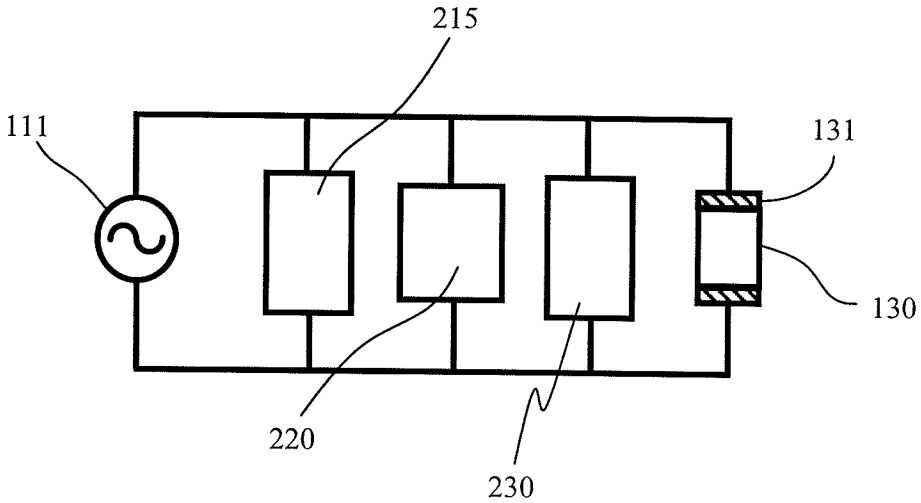
FIG. 1A is a generalized schematic of a gas-filled vessel capacitively coupled to an RF source.

FIG. 1A illustrates a general schematic for efficient energy transfer from an RF source 111 to gas fill vessel 130. This diagram as well as all of the other diagrams are intended to be illustrative of one implementation, which should not unduly limit the scope of the claims herein. One of ordinary skill in the art will recognize other variations, modifications, and alternatives. Energy from the RF source is directed to an impedance matching network 215 that enables the effective transfer of energy from RF source to resonating structure 220. An example of such impedance matching network is an E-field or H-field coupling element, but can be others. Another impedance matching network 230, in turn, enables efficient energy transfer from resonator to gas filled vessel 130 according to an embodiment of the present invention. An example of the impedance matching network is an E-field or H-field coupling element Of course, there can be other variations, modifications, and alternatives.

In a specific embodiment, the gas filled vessel is made of a suitable material such as quartz or other transparent or translucent material. The gas filled vessel is filled with an inert gas such as Argon and a fluorophor or light emitter such as Mercury, Sodium, Dysprosium, Sulfur or a metal halide salt such as Indium Bromide, Scandium Bromide, or Cesium Iodide (or it can simultaneously contain multiple fluorophors or light emitters). The gas filled vessel can also include a metal halide, or other metal pieces that will discharge electromagnetic radiation according to a specific embodiment. Of course, there can be other variations, modifications, and alternatives.

In a specific embodiment, a capacitive coupling structure 131 is used to deliver RF energy to the gas fill within the bulb 130. As is well known, a capacitive coupler typically comprises two electrodes of finite extent enclosing a volume and couples energy primarily using at least Electric fields (E-fields). As can be appreciated by one of ordinary skill in the art, the impedance matching networks 215 and 230 and the resonating structure 220, as depicted in schematic form here, can be interpreted as equivalent-circuit models of the distributed electromagnetic coupling between the RF source and the capacitive coupling structure. The use of impedance matching networks also allows the source to have an impedance other than 50 ohms; this may provide an advantage with respect to RF source performance in the form of reduced heating or power consumption from the RF source. Lowering power consumption and losses from the RF source would enable a greater efficiency for the lamp as a whole. As can also be appreciated by one of ordinary skill in the art, the impedance matching networks 215 and 230 are not necessarily identical.

Figure 1B:
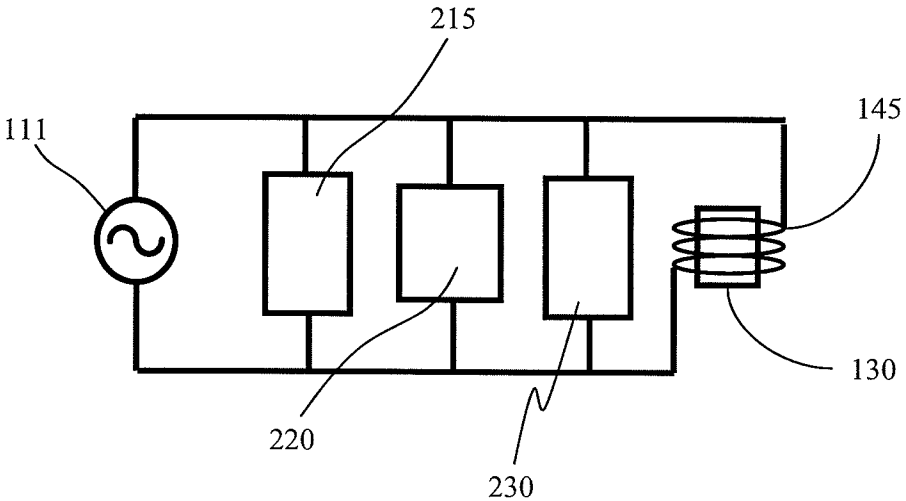
FIG. 1B is a generalized schematic of a gas-filled vessel inductively coupled to an RF source.

FIG. 1B illustrates a general schematic for efficient energy transfer from an RF source 111 to gas filled vessel 130. Energy from the RF source is directed to an impedance matching network 215 that enables the effective transfer of energy from RF source to resonating structure 220. Another impedance matching network 230, in turn, enables efficient energy transfer from the resonator to gas filled vessel 130. An inductive coupling structure 145 is used to deliver RF energy to the gas fill within the bulb 130. As is well known, an inductive coupler typically comprises a wire or a coil-like wire of finite extent and couples energy primarily using magnetic fields (H-fields). As can be appreciated by one of ordinary skill in the art, the impedance matching networks 215 and 230 and the resonating structure 220, as depicted in schematic form here, can be interpreted as equivalent-circuit models of the distributed electromagnetic coupling between the RF source and the inductive coupling structure. The use of impedance matching networks also allows the source to have an impedance other than 50 ohm; this may provide an advantage with respect to RF source performance in the form of reduced heating or power consumption from the RF source. Lowering power consumption and losses from the RF source would enable a greater efficiency for the lamp as a whole. As can also be appreciated by one of ordinary skill in the art, the impedance matching networks 215 and 230 are not necessarily identical.

Figure 2A:
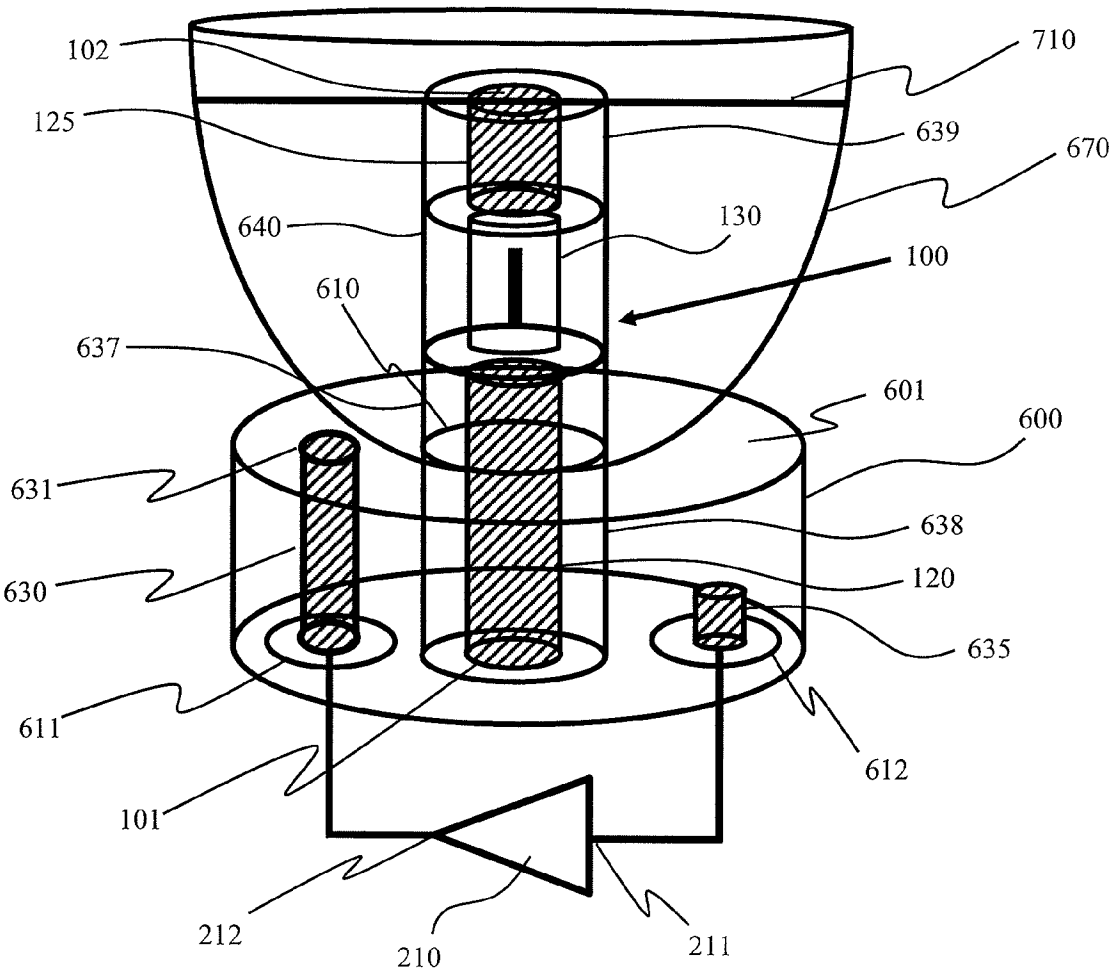
FIG. 2A is a simplified perspective view of an external resonator electrodeless lamp, including an RF amplifier.

FIG. 2A is a simplified perspective view of an electrodeless lamp, employing a lamp body 600, whose outer surface 601 is electrically conductive and is connected to ground. A cylindrical lamp body is depicted, but rectangular or other shapes may be used. This conductivity may be achieved through the application of a conductive veneer, or through the choice of a conductive material. An example embodiment of conductive veneer is silver paint or alternatively the lamp body can be made from sheet of electrically conductive material such as aluminum. An integrated bulb/output coupling-element assembly 100 is closely received by the lamp body 600 through opening 610. The bulb/output coupling-element assembly 100 contains the bulb 130, which is a gas-filled vessel that ultimately produces the luminous output.

One aspect of the invention is that the bottom of the assembly 100, output coupling-element 120, is grounded to the body 600 and its conductive surface 601 at plane 101. The luminous output from the bulb is collected and directed by an external reflector 670, which is either electrically conductive or if it is made from a dielectric material has an electrically conductive backing, and which is attached to and in electrical contact with the body 600. Another aspect of the invention is that the top of the assembly 100, top coupling-element 125, is grounded to the body 600 at plane 102 via the ground strap 710 and the reflector 670. Alternatively, the reflector 670 may not exist, and the ground strap makes direct electrical contact with the body 600. Reflector 670 is depicted as parabolic in shape with bulb 130 positioned near its focus. Those of ordinary skill in the art will recognize that a wide variety of possible reflector shapes can be designed to satisfy beam-direction requirements. In a specific embodiment, the shapes can be conical, convex, concave, trapezoidal, pyramidal, or any combination of these, and the like. The shorter feedback E-field coupling-element 635 couples a small amount of RF energy from the bulb/output coupling-element assembly 100 and provides feedback to the RF amplifier input 211 of RF amplifier 210. Feedback coupling-element 635 is closely received by the lamp body 600 through opening 612, and as such is not in direct DC electrical contact with the conductive surface 601 of the lamp body. The input coupling-element 630 is conductively connected with RF amplifier output 212. Input coupling-element 630 is closely received by the lamp body 600 through opening 611, and as such is not in direct DC electrical contact with the conductive surface 601 of the lamp body. However, it is another key aspect of the invention that the top of the input coupling-element is grounded to the body 600 and its conductive surface 601 at plane 631.

RF power is primarily inductively coupled strongly from the input coupling-element 630 to the bulb/output coupling-element assembly 100 through physical proximity, their relative lengths, and the relative arrangement of their ground planes. Surface 637 of bulb/output coupling-element assembly is covered with an electrically conductive veneer or an electrically conductive material and is connected to the body 600 and its conductive surface 601. Alternatively it can integrated as part of the lamp body 600. The other surfaces of the bulb/output coupling-element assembly including surfaces 638, 639, and 640 are not covered with a conductive layer. In addition surface 640 is optically transparent or translucent. The coupling between input coupling-element 630 and output coupling-element 120 and lamp assembly 100 is found through electromagnetic simulation, and through direct measurement, to be highly frequency selective and to be primarily inductive. This frequency selectivity provides for a resonant oscillator in the circuit comprising the input coupling-element 630, the bulb/output coupling-element assembly 100, the feedback coupling-element 635, and the amplifier 210.

One of ordinary skill in the art will recognize that the resonant oscillator is the equivalent of the RF source 111 depicted schematically in FIG. 1A and FIG. 1B. A significant advantage of the invention is that the input coupling-element 630 and the bulb/output coupling-element assembly 100 are respectively grounded at planes 631 and 101, which are coincident with the outer surface of the body 600. This eliminates the need to fine-tune their depth of insertion into the lamp body—as well as any sensitivity of the RF coupling between them to that depth—simplifying lamp manufacture, as well as improving consistency in lamp brightness yield.

Figure 2B:
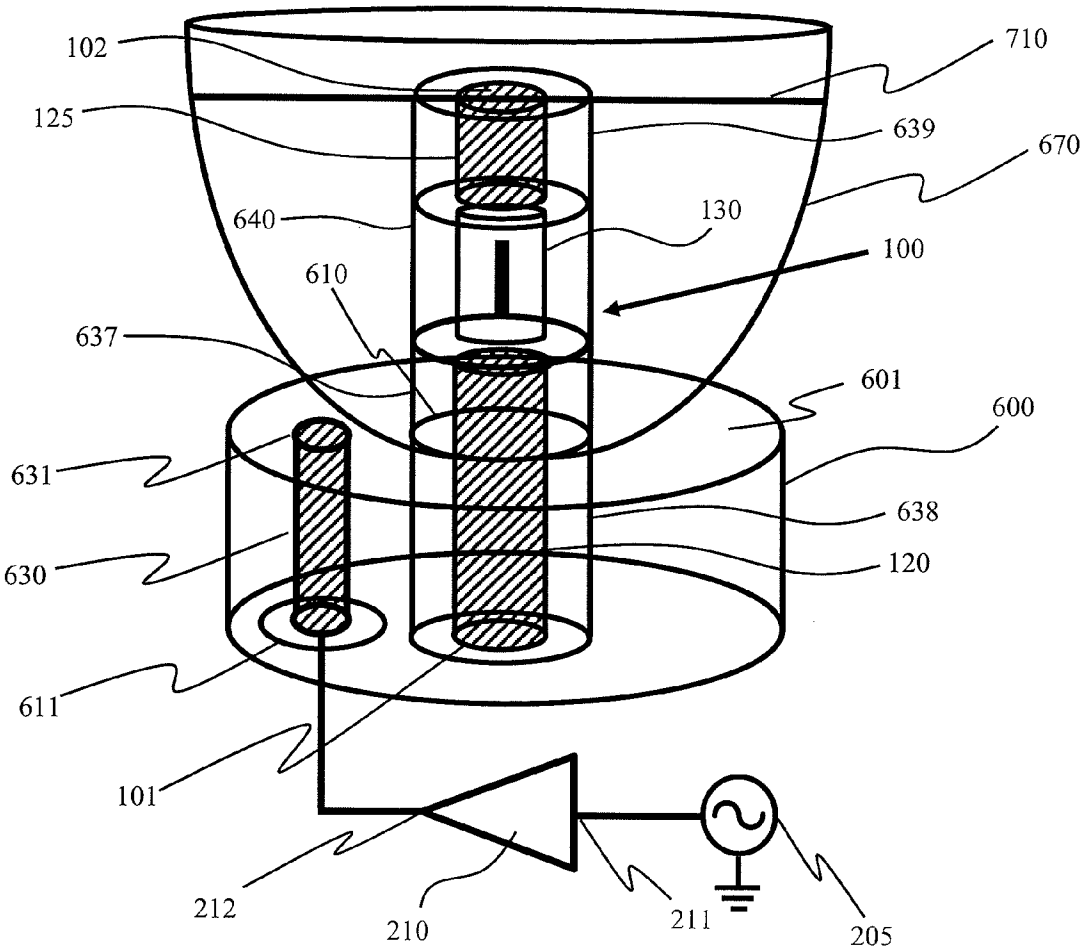
FIG. 2B is a simplified perspective view of an alternate external resonator electrodeless lamp, including an RF source.

FIG. 2B is a simplified perspective view of an electrodeless lamp that differs from that shown in FIG. 2A only in its RF source, which is not a distributed oscillator circuit, but rather a separate oscillator 205 conductively connected with RF amplifier input 211 of the RF amplifier 210. RF amplifier output 212 is conductively connected with input coupling-element 630, which delivers RF power to the lamp/output coupling-element assembly 100. The resonant characteristics of the coupling between the input coupling-element 630 and the output coupling-element in the bulb/output coupling-element assembly 100 are frequency-matched to the RF source to optimize RF power transfer. Of course, there can be other variations, modifications, and alternatives.

Figure 2C:
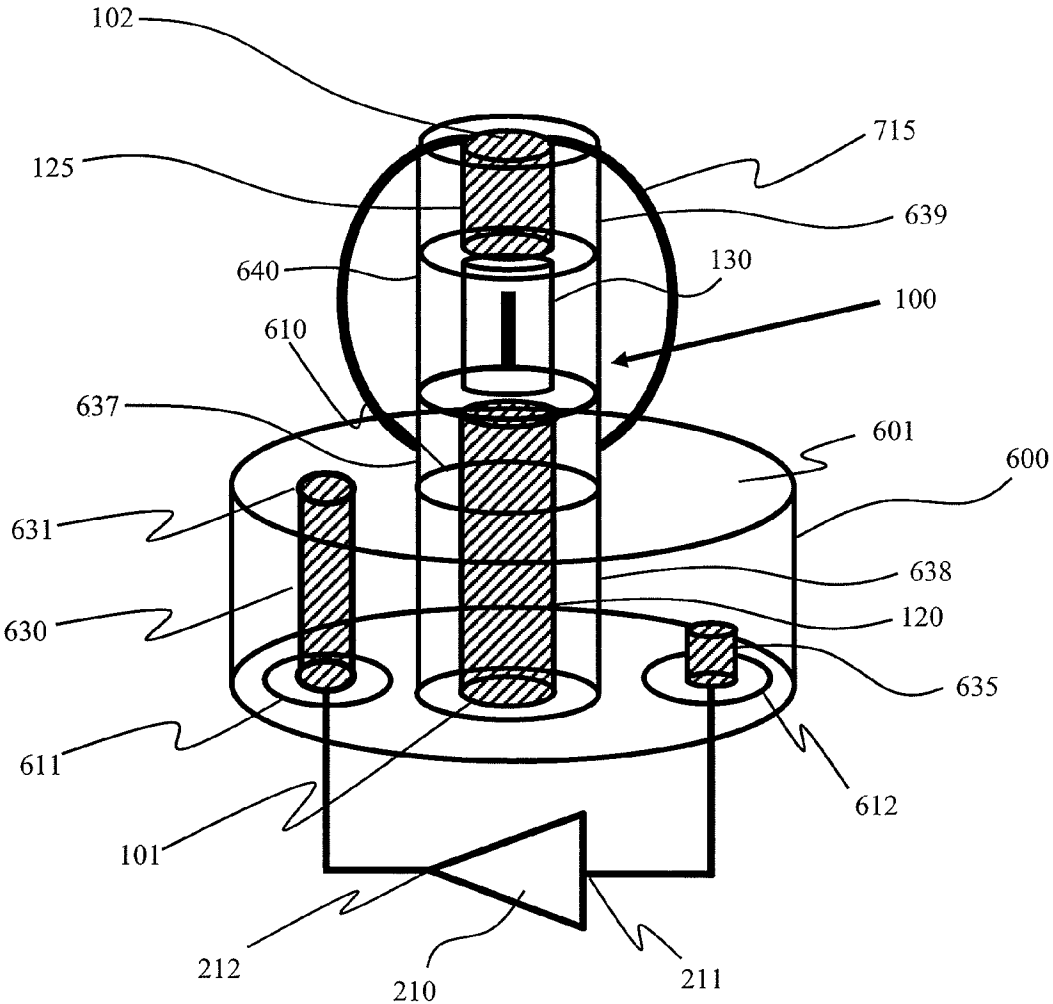
FIG. 2C is a simplified perspective view of an alternate external resonator electrodeless lamp.

FIG. 2C is a simplified perspective view of an electrodeless lamp that is similar to the electrode-less lamp shown in FIG. 2A except that it does not have a reflector 670. The top coupling-element 125 in the bulb assembly is directly connected to the lamp body 600 using ground straps 715. This diagram is merely an example, which should not unduly limit the scope of the claims herein. One of ordinary skill in the art would recognize other variations, modifications, and alternatives.

Figure 3B:
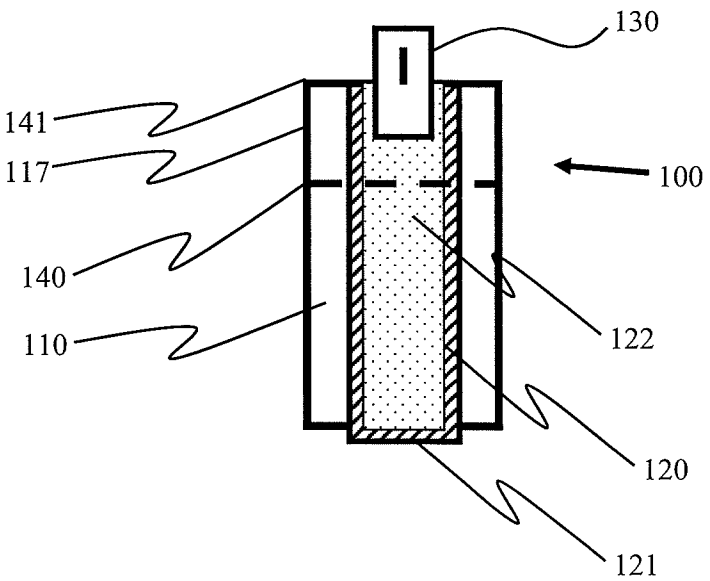
FIG. 3B is a simplified side-cut view of the integrated bulb/output coupling-element assembly shown in FIG. 3A.
Figure 3A:
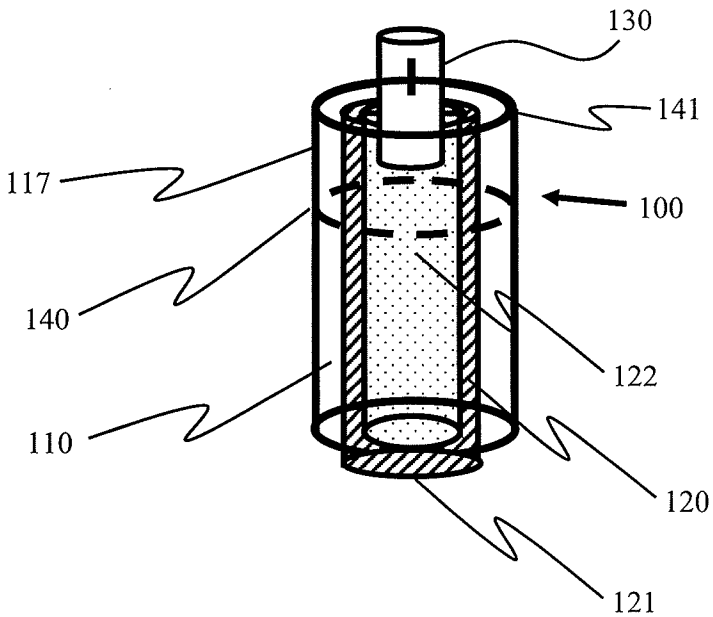
FIG. 3A is a simplified perspective view of an integrated bulb/output coupling-element without a top coupling-element.

FIG. 3A is a simplified perspective view of an alternative design for an integrated bulb/output coupling-element assembly 100. The assembly does not contain a top coupling-element. The assembly consists of two sections. The bottom section 110 contains the output coupling-element 120 which consists of a dielectric post 122 made from a material such as alumina with its outer surface coated with a conductive veneer such as silver. The top section consists of the bulb (gas-fill vessel) 130 which is made from a material that is transparent to visible light such as quartz or translucent alumina. It is a key aspect of the invention that dielectric post of the output coupling-element 120 is bored to closely receive bulb 130, such that heat transfer through its dielectric center and RF coupling through its conductive outer coating take place simultaneously. The area of the dielectric post of the output coupling-element that come in contact with the bulb is not covered with a conductive veneer. Using this bulb assembly approach the high RF fields is kept away from the end of bulb resulting in a more reliable lamp. It is also a key aspect of this invention that output coupling-element 120 makes ground contact at plane 121 with the lamp body 600 depicted in FIGS. 2A, 2B, and 2C.

The portion of body 110 that is received by the lamp body 600 as depicted in FIGS. 2A, 2B, and 2C (and overlaps with the length of input coupling-element 630) and is shown in FIG. 3A as being below the dashed line 140; is not coated with a conductive layer. The portion of body 110 that is above the lamp body 600 but substantially below the bulb 130 is depicted schematically as the area between 140 and 141; this portion may be coated with a conductive veneer 117. The purpose of the conductive coatings is to shield against unwanted electromagnetic radiation. An example embodiment of conductive veneer 117 is silver paint. Alternatively, instead of a conductive veneer, portion of the body 110 between 140 and 141 can be covered by a metal ring 650 as part of the extension of the lamp body 600.

FIG. 3B is a simplified side-cut view of an integrated bulb/output coupling-element assembly 100 shown in FIG. 3A.

Figure 3D:
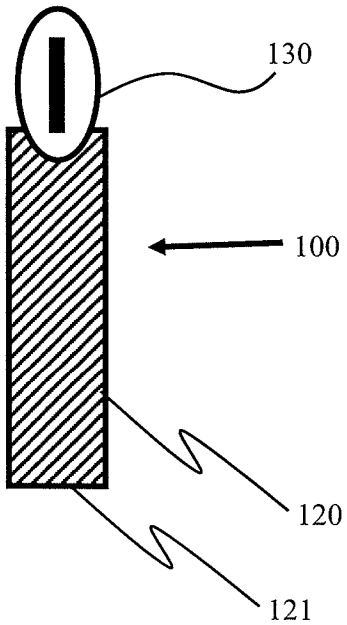
FIG. 3D is a simplified side-cut view of the alternate integrated bulb/output coupling element assembly shown in FIG. 3C.
Figure 3C:
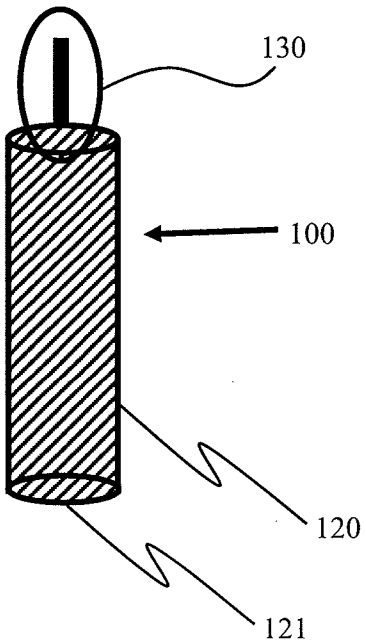
FIG. 3C is a simplified perspective view of an alternate integrated bulb/output coupling-element assembly to the one shown in FIG. 3A.
Figure 7A:
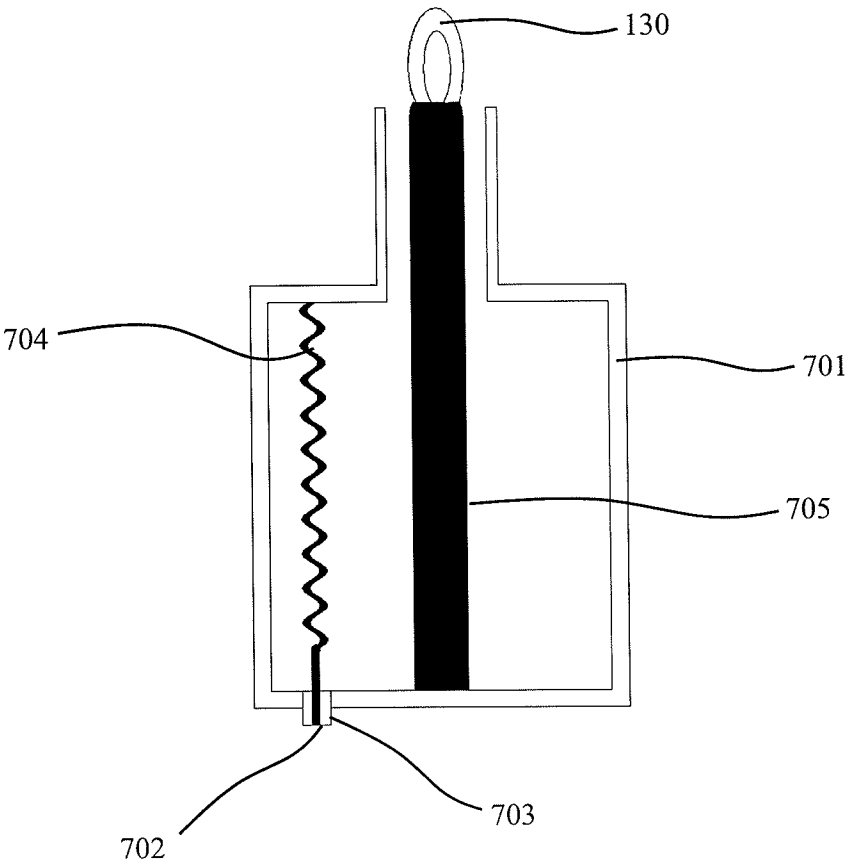
FIG. 7A is a simplified cross section of a coil electrodeless lamp where the resonator coupling element is a coil and is separated by a gap from the output support structure according to an embodiment of the present invention. The output support structure can be any embodiment of the structures described in the preceding figures or it can be a straight metal structure that is grounded on one side.

FIG. 3C is a perspective view of an alternative design for an integrated bulb/output coupling-element assembly 100 which is the same as the output support structure depicted in FIG. 7A. The assembly is made using a solid conductor (metal post) 120 and is recessed at the top to closely receive one end of the gas-filled vessel 130. The other end of metal post 121 is grounded to the lamp body. A thin layer of dielectric material or refractory metal such as molybdenum can be used as interface between the bulb and the metal post. Alternatively the top part of the metal post or all of the metal post can be made from a refractory metal with its outer surface covered with a layer of metal with high electrical conductivity such as silver or copper. The metal post can also be hollow inside or filled with a different metal with higher thermal conductivity. The assembly has no top coupling element.

FIG. 3D is a side-cut view of an integrated bulb/output coupling-element assembly 100 shown in FIG. 3C. The bulb/output coupling-element is similar to FIG. 3B except the post is made from a solid conductor instead of a dielectric material covered with conductive layer. This diagram is merely an example, which should not unduly limit the scope of the claims herein. One of ordinary skill in the art would recognize other variations, modifications, and alternatives.

Figure 4B:
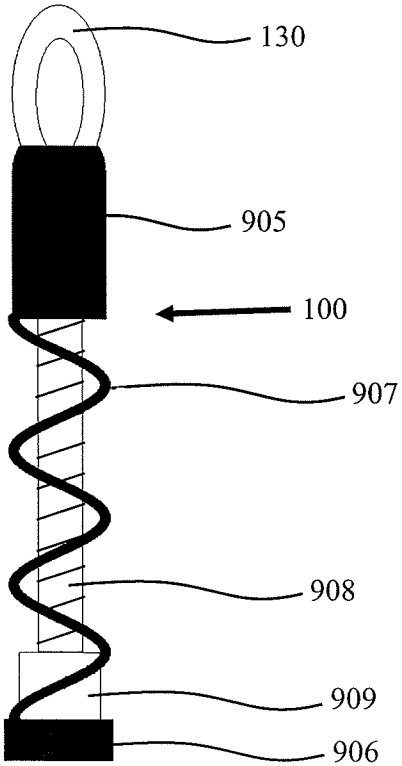
FIG. 4B is a simplified perspective view of an alternate integrated bulb/output coupling-element that is helically shaped in structure and encompasses a dielectric material with a metal insert that allows for the tuning of the resonance frequency according to an embodiment of the present invention.
Figure 4A:
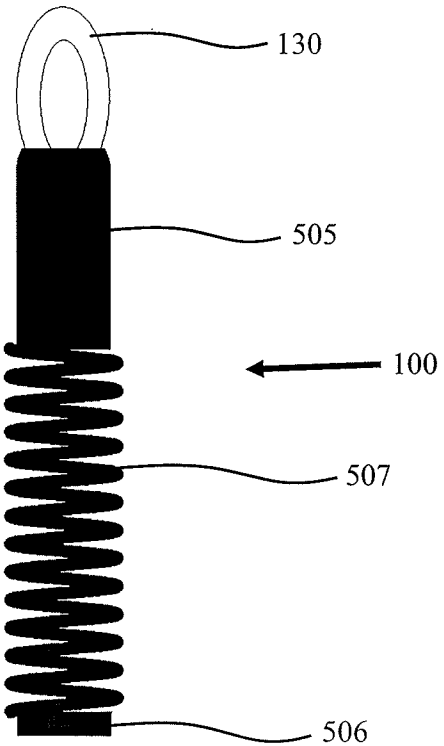
FIG. 4A is a simplified perspective view of an alternate integrated bulb/output coupling-element that is helically shaped in structure and encompasses air according to an embodiment of the present invention.
Figure 5A:
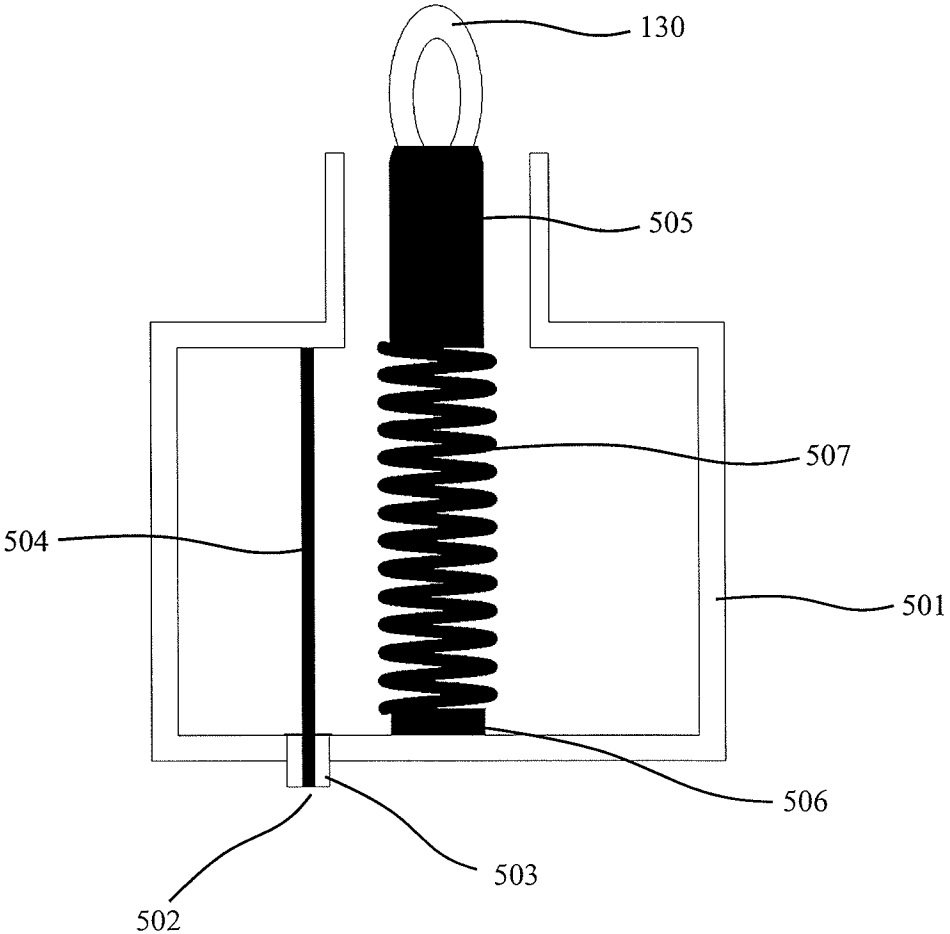
FIG. 5A is a simplified cross section of a coil electrodeless lamp where the output support structure that contains the gas-filled vessel is separated from a grounded support structure by a single metal coil element according to an embodiment of the present invention. It is coupled to a resonator coupling element that is straight and adjacent to the output support structure.

FIG. 4A is a simplified perspective view of an embodiment of the present invention including an RF output coupling-element that is helical in structure and encompasses air. The helical structure 507 can have anywhere from 2 to 30 windings. In other embodiments, the windings can be more than one winding, including portions, and may be greater than thirty windings. In still other embodiments, the windings can be a portion of one winding. The output coupling-element includes a conductive metal and is attached to the metal post structure 505 that holds the bulb 130 in place. The metal used in the output coupling-element can be but is not limited to aluminum, brass, copper, gold, or silver. the other end of the RF output coupling-element 506 is grounded to the outer conductive surface of the lamp body as illustrated in FIG. 5A. Thus the design serves as an effective means of coupling the RF energy to the gas filled vessel created by the RF source that flows into the resonating structure.

An advantage of the present embodiment is that the post and helical structure RF output-coupling element serve as a more effective means of dissipating heat from the bulb within the resonating structure thus creating improved device heat transfer characteristics. That is, the post structure draws a substantial portion of the thermal energy generated from the bulb away through the material or coatings of the post structure, while maintaining the helical structure at a desirable temperature. Such desirable temperature leads to desirable conductive characteristics of the helical structure to maintain the performance (e.g., efficiency) of the plasma apparatus according to a specific embodiment. During the creation of a plasma, a great amount of heat is generated. The particles in the plasmas generated by such devices typically are at a temperature on the order of one thousand degree or of several thousand degrees Celsius. In order to prevent damage to the lamp and for the overall safety of the device, an effective means of dissipating the heat generated by the bulb is necessary. As the helical RF output coupling-element is coupled directly to the metal base which holds the bulb, the generated heat is conducted into the RF output coupling-element. The use of a helical shaped RF output coupling-element creates a structure with a larger surface area in which the heat can dissipate into the air. By creating a larger surface area in which the surrounding air comes into contact with, a greater amount of heat is dissipated from the bulb and out through the RF output-coupling element. The improved heat transfer characteristics of the lamp, leads to improved reliability and safety.

Another advantage of the present embodiment is that the use of a helical RF output coupling-element lowers the resonant frequency of the device, thereby allowing the device to operate at lower RF frequencies. Specifically, in creating a helical shaped RF output coupling-element structure, creates a large amount of magnetic flux within the structure, in turn leading to increased inductance levels of between 50% to about 1000% of that of the resonator structure according to one or more embodiments. In one or more preferred embodiments, the inductance increases from about 1.1 to $10^6$ and greater. That is, the operating resonating frequency may be 50 kHz and greater, e.g., 10 MHz. The resonance frequency of the device is inversely related to the inductance, therefore at higher inductance levels, the resonance frequency is decreased. In decreasing the resonance frequency in the range of 8 MHz to about 1000 MHz, the device is capable of operating at lower RF frequencies, in turn becoming more efficient. Of course, there can be other variations, modifications, and alternatives.

Figure 9:
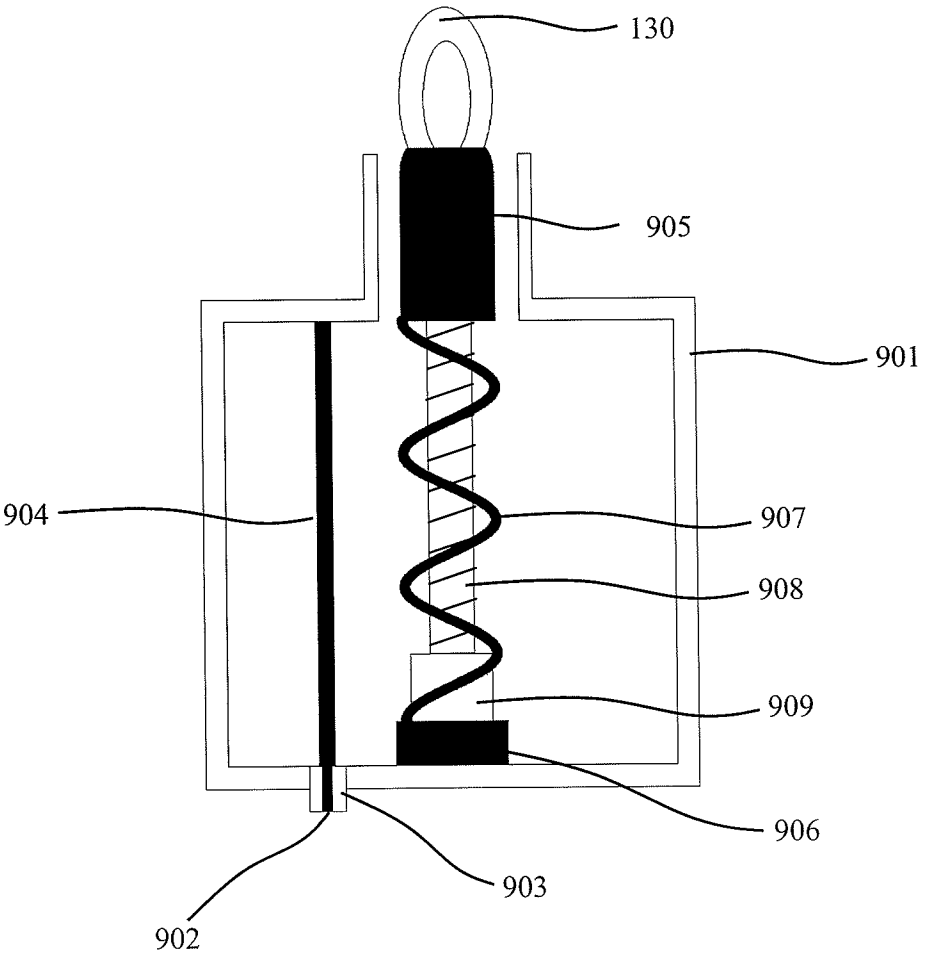
FIG. 9 is a simplified cross section of a coil electrodeless lamp where the output support structure that contains the gas-filled vessel is separated from a grounded support structure by a single metal coil element. It is coupled to a resonator couple element that is straight and adjacent to the output support structure. There is an adjustable metal insert within the coil output support structure that travels along the axis of the coil that allows for adjustment of the operating frequency of the resonator according to an embodiment of the present invention.

FIG. 4B is a simplified perspective view of an alternate embodiment of the present invention consisting of an RF output coupling-element that is helical in structure 907 and encompasses a dielectric material 908 with a metal insert 909 that allows for the tuning of the resonance frequency of the resonator. As with the previous embodiment, the RF output coupling-element of the present embodiment is connected to the metal post structure 905 that is used to support the bulb 130. The other end of the output coupling-element 906 is grounded to the outer surface of the conductive lamp body as illustrated in FIG. 9.

The present embodiment incorporates a dielectric material within the helical RF output coupling-element. Such dielectric material can be but is not limited to Alumina or any other suitable dielectric or ceramic material. The dielectric material does not conduct the current that is generated from the RF source and flows through the RF output-coupling element, however, the dielectric material does absorb the heat from the helical coils of the RF output coupling-element and the heat from the bulb through the top of the coupling element 905. Since dielectric materials are capable of absorbing large amounts of heat while providing electrical isolation, the use of a dielectric within the RF output coupling-element further improves the heat transfer characteristics of the lamp. Using a helical output coupling-element increases the inductance of the resonator reducing the resonance frequency of the resonator, thereby allowing for operation the lamp at lower RF frequencies.

The present embodiment also incorporates a metal insert 909 between the dielectric material and the helical RF output coupling-element. The metal insert makes contact at one end with the helical RF output coupling element and at the other end makes contact with the base 906 of the output coupling-element. The length of the metal insert is less than the length of the entire helical RF output coupling-element. However, the length of the metal insert can be adjusted such that it can make contact at different positions along the length of the helical RF output coupling element. One method of adjusting the length of the metal insert is by using screw threads along the length of the metal insert and turning the metal insert into the base of the output coupling element to adjust its length. Of course other methods of adjusting the length of the metal insert are possible. As the length of the metal insert is adjusted such that it makes contact with the helical output coupling-element at different positions, the inductance of the output coupling-element changes resulting in changes in the resonant frequency of the resonator. The metal insert can be used to tune the resonant frequency of the resonator to optimize the performance of the lamp and improve manufacturing yield.

FIG. 5A illustrates the cross-section for a coil electrodeless plasma lamp according to an embodiment of the present invention. Energy from an RF source is directed to the input port 502 of the resonator enclosure 501. RF Energy is coupled into the resonator enclosure 501 through a standard RF connector 503. A straight resonator coupling element 504 that has one end connected to the RF connector and the other end grounded, directs the RF energy inside the resonator and couples the energy to the output support structure comprised of elements 505, 506, and 507. The output support structure is comprised of three elements. The conductive grounded support base 506 provides a physical and electrical connection to the resonator on one end and a connection to the coil element 507 on the other end. The coil element is an electrically conductive material configured into a helical structure to extend through the resonator enclosure to support and connect to the output support structure 505. The output support structure 505 can be made of any electrically conductive or non-conductive material (ceramic) but must have its surface covered with an electrically conductive layer. The output support structure directs the RF energy that is coupled to it from the resonator coupling element 504 into the gas-filled vessel 130 where light is produced.

Figure 5B:
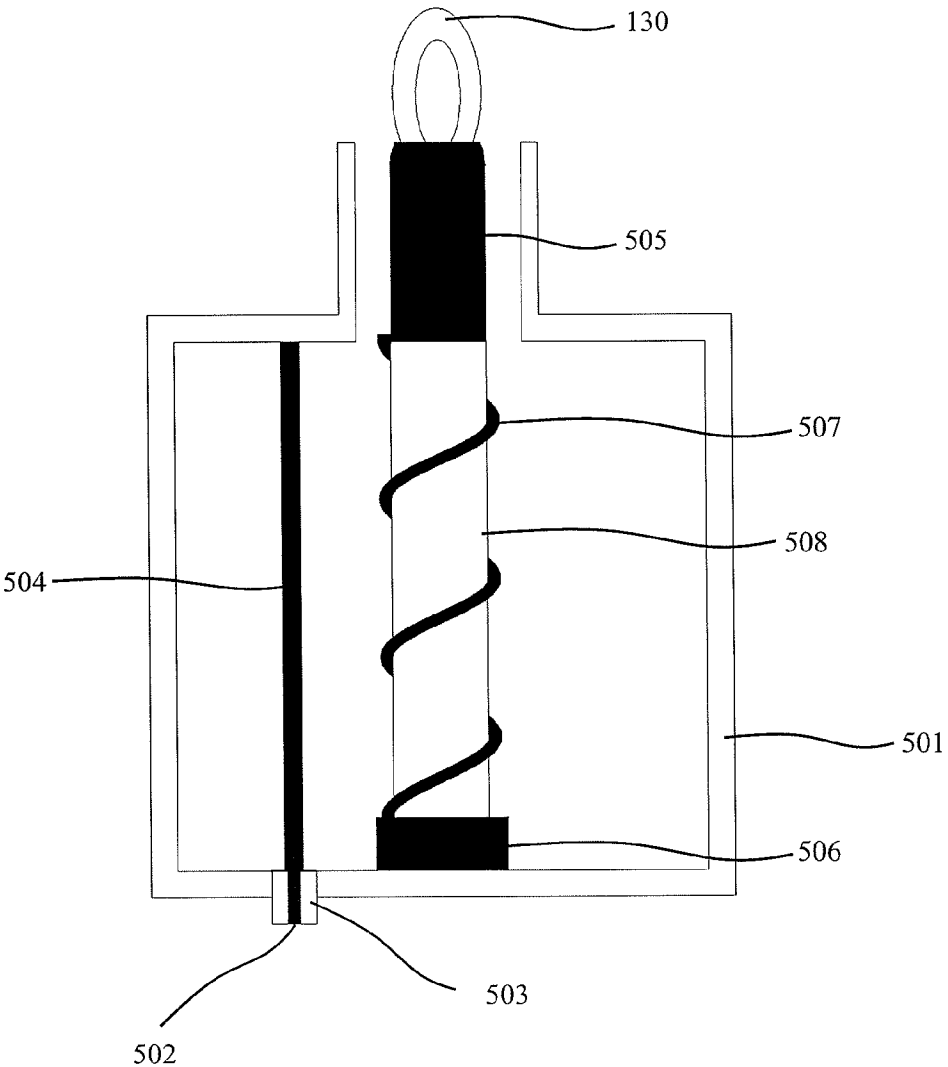
FIG. 5B is a simplified cross section of a coil electrodeless lamp where the output support structure that contains the gas-filled vessel is separated from the grounded support structure by a metal coil element wound tightly to a non-conductive support structure according to an embodiment of the present invention. It is coupled to a resonator coupling element that is straight and adjacent to the output support structure.

FIG. 5B illustrates the cross-section for a coil electrodeless plasma lamp according to an embodiment of the present invention. Energy from an RF source is directed to the input port 502 of the resonator enclosure 501. RF Energy is coupled into the resonator enclosure 501 through a standard RF connector 503. A straight resonator coupling element 504 that has one end connected to the RF connector and the other end grounded, directs the RF energy inside the resonator and couples the energy to the output support structure comprised of elements 505, 506, 507, and 508. The output support structure is comprised of four elements. The conductive grounded support base 506 provides a physical and electrical connection to the resonator on one end and a connection to the coil element 507 on the other end. The coil element is an electrically conductive material configured into a helical structure to extend through the resonator enclosure. A non-conductive (ceramic) support structure 508 is used to physically support the coil element 507 and output support structure 505 and facilitate heat transfer from the gas-filled vessel 130 to the rest of the resonator. It is directly attached to the output support structure 505. The output support structure can be made of any electrically conductive or non-conductive material (ceramic) but must have its surface covered with an electrically conductive layer. The output support structure directs the RF energy that is coupled to it from the resonator coupling element 504 into the gas-filled vessel 130 where light is produced.

Figure 5C:
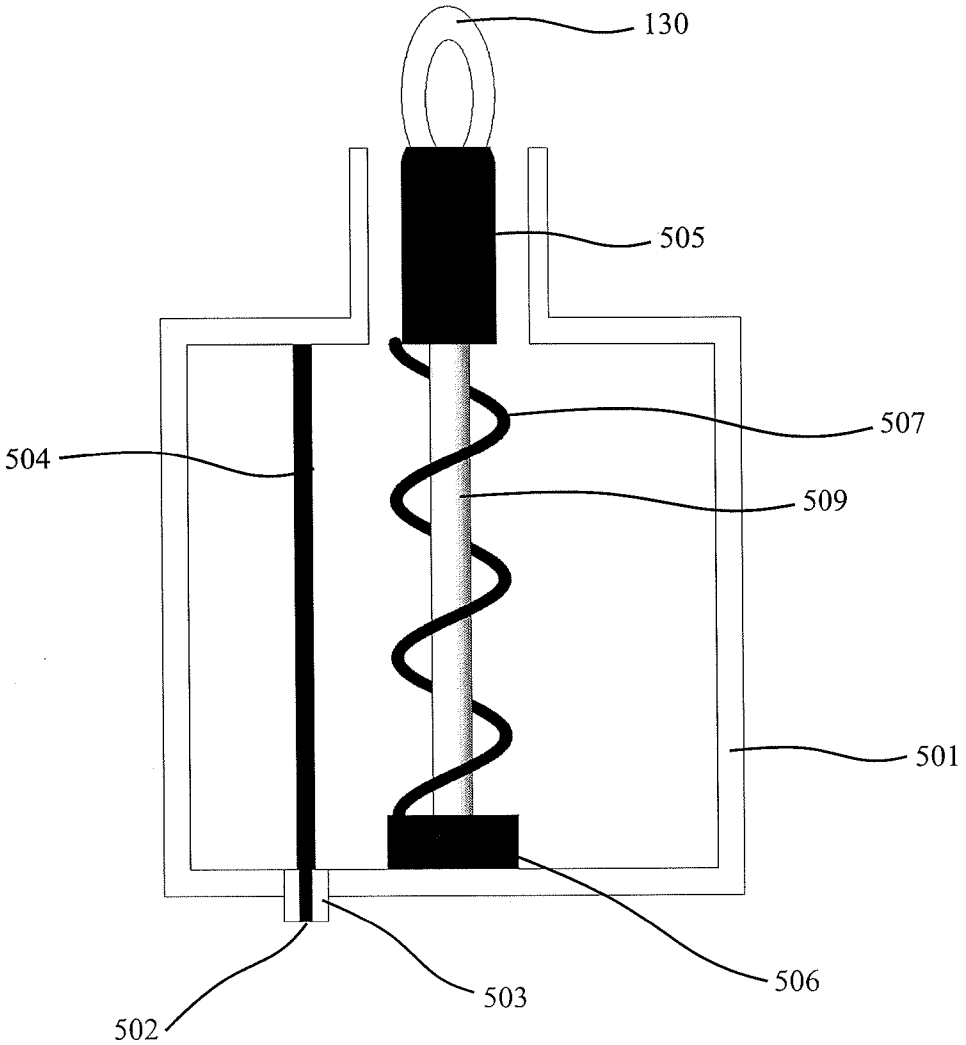
FIG. 5C is a simplified cross section of a coil electrodeless lamp where the output support structure that contains the gas-filled vessel is separated from the grounded support structure by a metal coil element wound around but not touching a non-conductive support structure according to an embodiment of the present invention. It is coupled to a resonator coupling element that is straight and adjacent to the output support structure.

FIG. 5C illustrates the cross-section for a coil electrodeless plasma lamp according to an embodiment of the present invention. Energy from an RF source is directed to the input port 502 of the resonator enclosure 501. RF Energy is coupled into the resonator enclosure 501 through a standard RF connector 503. A straight resonator coupling element 504 that has one end connected to the RF connector and the other end grounded, directs the RF energy inside the resonator and couples the energy to the output support structure comprised of elements 505, 506, 507, and 509. The output support structure is comprised of four elements. The conductive grounded support base 506 provides a physical and electrical connection to the resonator on one end and a connection to the coil element 507 on the other end. The coil element is an electrically conductive material configured into a helical structure to extend through the resonator enclosure. A non-conductive (ceramic) support structure 509 is used to physically support the output support structure 505 and facilitate heat transfer from the gas-filled vessel 130 to the rest of the resonator. It is directly attached to the output support structure 505. The output support structure can be made of any electrically conductive or non-conductive material (ceramic) but must have its surface covered with an electrically conductive layer. The output support structure directs the RF energy that is coupled to it from the resonator coupling element 504 into the gas-filled vessel 130 where light is produced.

Figure 5D:
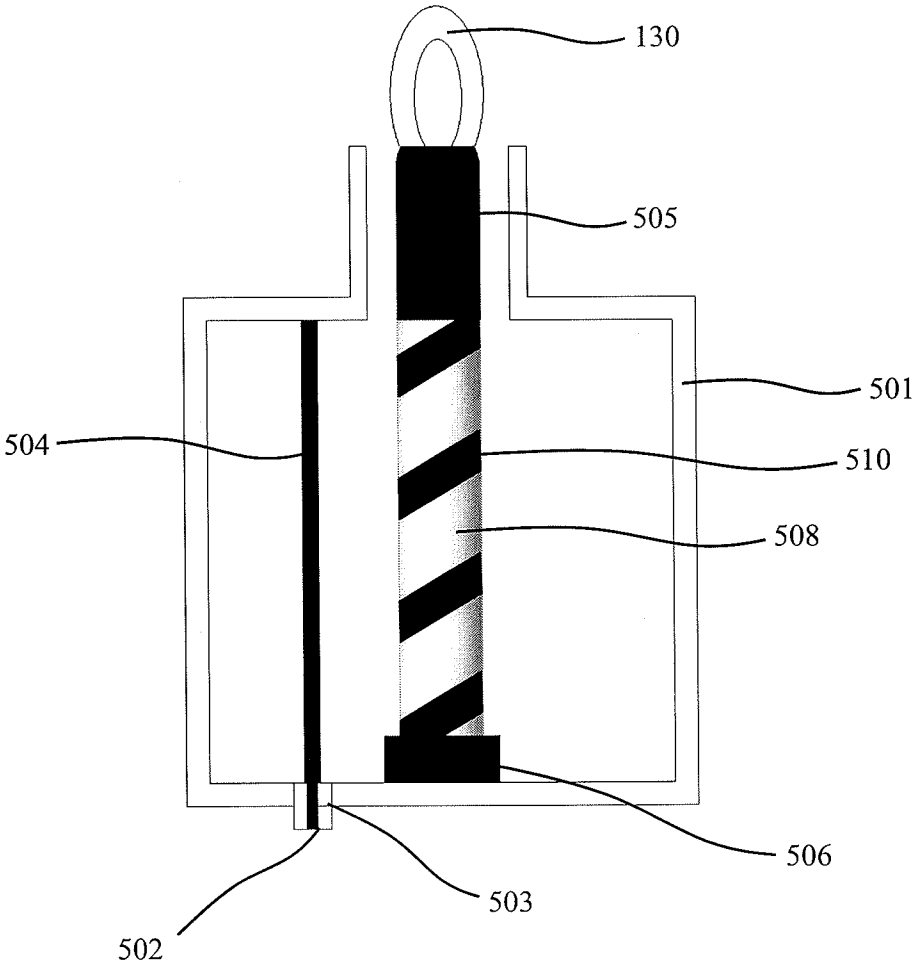
FIG. 5D is a simplified cross section of a coil electrodeless lamp where the output support structure that contains the gas-filled vessel is separated from the grounded support structure by a spiral coil strips attached or painted around a non-conductive support structure according to an embodiment of the present invention. It is coupled to a resonator coupling element that is straight and adjacent to the output support structure.

FIG. 5D illustrates the cross-section for a coil electrodeless plasma lamp according to an embodiment of the present invention. Energy from an RF source is directed to the input port 502 of the resonator enclosure 501. RF Energy is coupled into the resonator enclosure 501 through a standard RF connector 503. A straight resonator coupling element 504 that has one end connected to the RF connector and the other end grounded, directs the RF energy inside the resonator and couples the energy to the output support structure comprised of elements 505, 506, 508, and 510. The output support structure is comprised of four elements. The conductive grounded support base 506 provides a physical and electrical connection to the resonator on one end and a connection to the coil element 510 on the other end. The coil element is an electrically conductive material configured in the shape of conductive stripes onto the non-conductive (ceramic) support structure 508 and provides an electrical connection to the output support structure 505. The non-conductive support structure 508 is used to physically support the output support structure 505 and facilitate heat transfer from the gas-filled vessel 130 to the rest of the resonator. It is directly attached to the output support structure 505. The output support structure can be made of any conductive or non-conductive material (ceramic) but must have its surface covered with an electrically conductive layer. The output support structure directs the RF energy that is coupled to it from the resonator coupling element 504 into the gas-filled vessel 130 where light is produced.

Figure 6A:
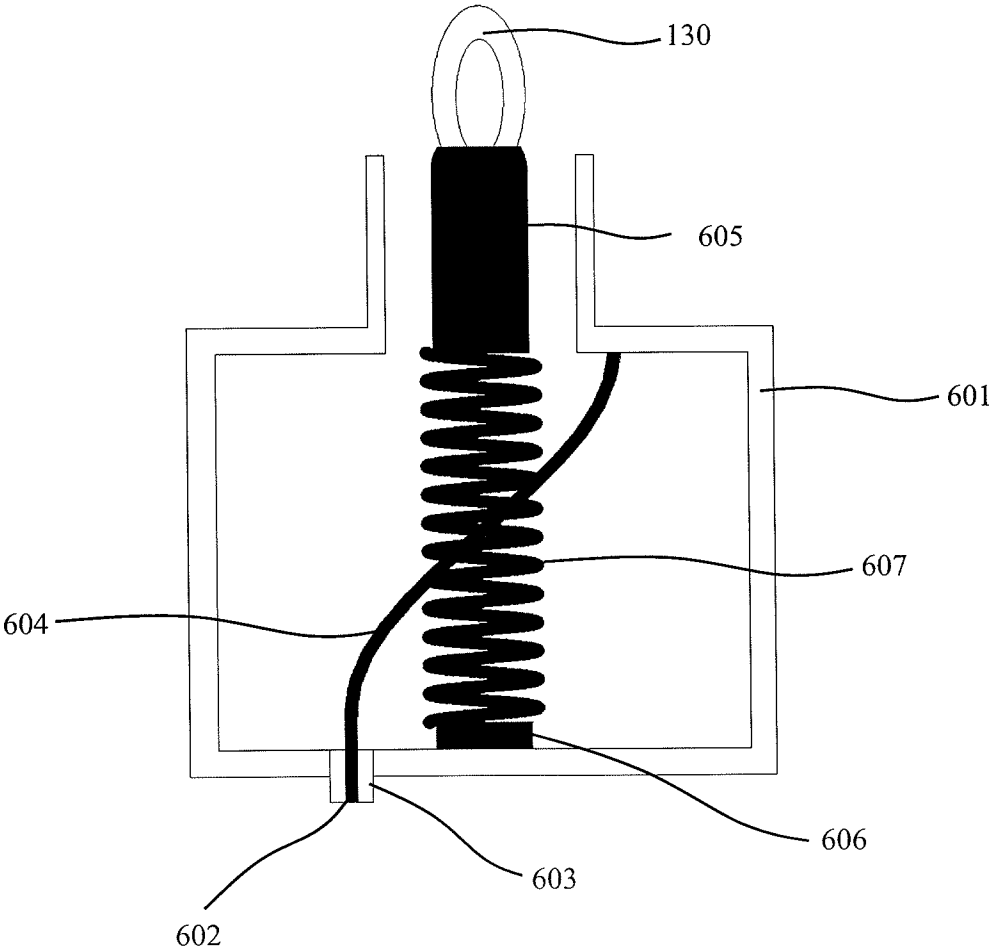
FIG. 6A is a simplified cross section of a coil electrodeless lamp where the output support structure that contains the gas-filled vessel is separated from a grounded support structure by a single metal coil element. It is coupled to a resonator coupling element that is a second coil that surrounds the first coil element according to an embodiment of the present invention.

FIG. 6A illustrates the cross-section for a coil electrodeless plasma lamp according to an embodiment of the present invention. Energy from an RF source is directed to the input port 602 of the resonator enclosure 601. RF Energy is coupled into the resonator enclosure 601 through a standard RF connector 603. A coil resonator coupling element 604 that has one end connected to the RF connector and the other end grounded surrounds the center support structure assembly and directs the RF energy inside the resonator to couple the energy to the output support structure comprised of elements 605, 606, and 607. The output support structure is comprised of three elements. The conductive grounded support base 606 provides a physical and electrical connection to the resonator on one end and a connection to the coil element 607 on the other end. The coil element is an electrically conductive material configured into a helical structure to extend through the resonator enclosure to support and connect to the output support structure 605. The output support structure 605 can be made of any electrically conductive or non-conductive material (ceramic) but must have its surface covered with an electrically conductive layer. The output support structure directs the RF energy that is coupled to it from the resonator coupling element 604 into the gas-filled vessel 130 where light is produced.

Figure 6B:
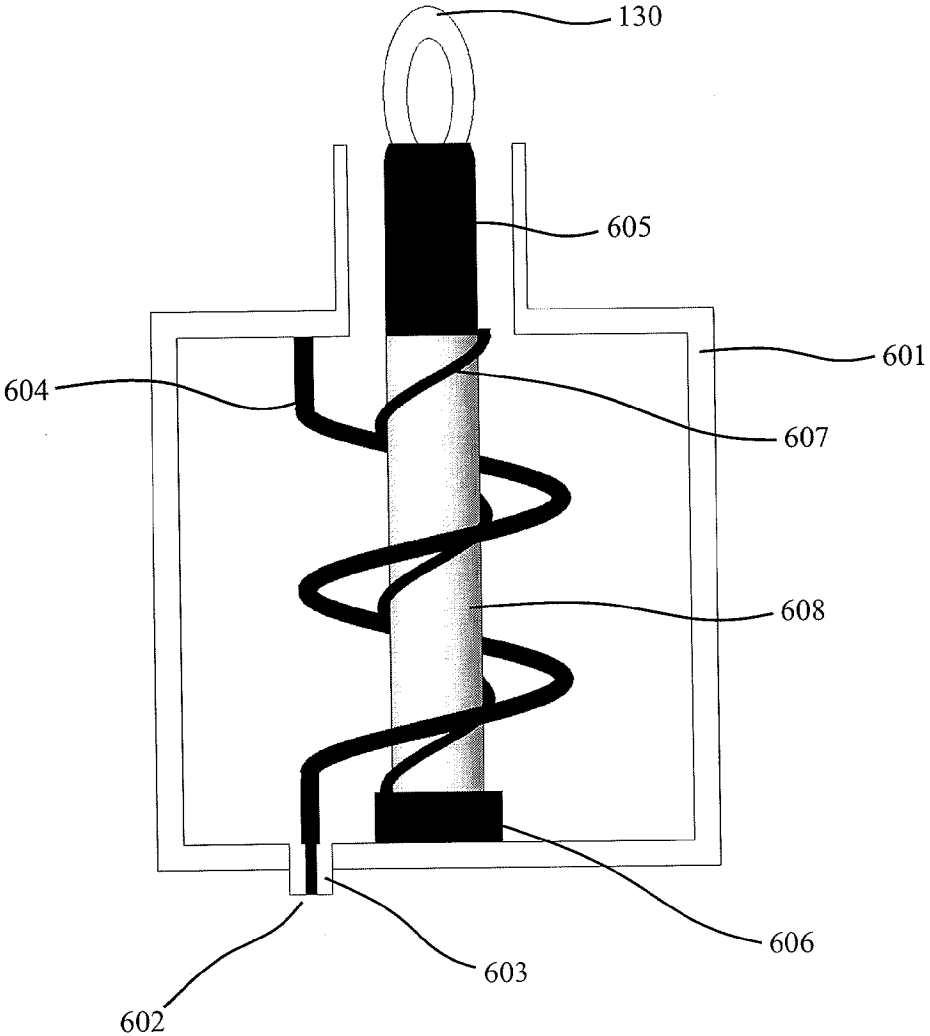
FIG. 6B is a simplified cross section of a coil electrodeless lamp where the output support structure that contains the gas-filled vessel is separated from the grounded support structure by a metal coil element wound tightly to a non-conductive support structure. It is coupled to a resonator coupling element that is a second coil that surrounds the first coil element according to an embodiment of the present invention.

FIG. 6B illustrates the cross-section for a coil electrodeless plasma lamp according to an embodiment of the present invention. Energy from an RF source is directed to the input port 602 of the resonator enclosure 601. RF Energy is coupled into the resonator enclosure 601 through a standard RF connector 603. A coil resonator coupling element 604 that has one end connected to the RF connector and the other end grounded surrounds the center support structure assembly and directs the RF energy inside the resonator to couple the energy to the output support structure comprised of elements 605, 606, 607, and 608. The output support structure is comprised of four elements. The conductive grounded support base 606 provides a physical and electrical connection to the resonator on one end and a connection to the coil element 607 on the other end. The coil element is an electrically conductive material configured into a helical structure to extend through the resonator enclosure. A non-conductive (ceramic) support structure 608 is used to physically support the coil element 607 and output support structure 605 and facilitate heat transfer from the gas-filled vessel 130 to the rest of the resonator. It is directly attached to the output support structure 605. The output support structure can be made of any electrically conductive or non-conductive material (ceramic) but must have its surface covered with an electrically conductive layer. The output support structure directs the RF energy that is coupled to it from the resonator coupling element 604 into the gas-filled vessel 130 where light is produced.

Figure 6C:
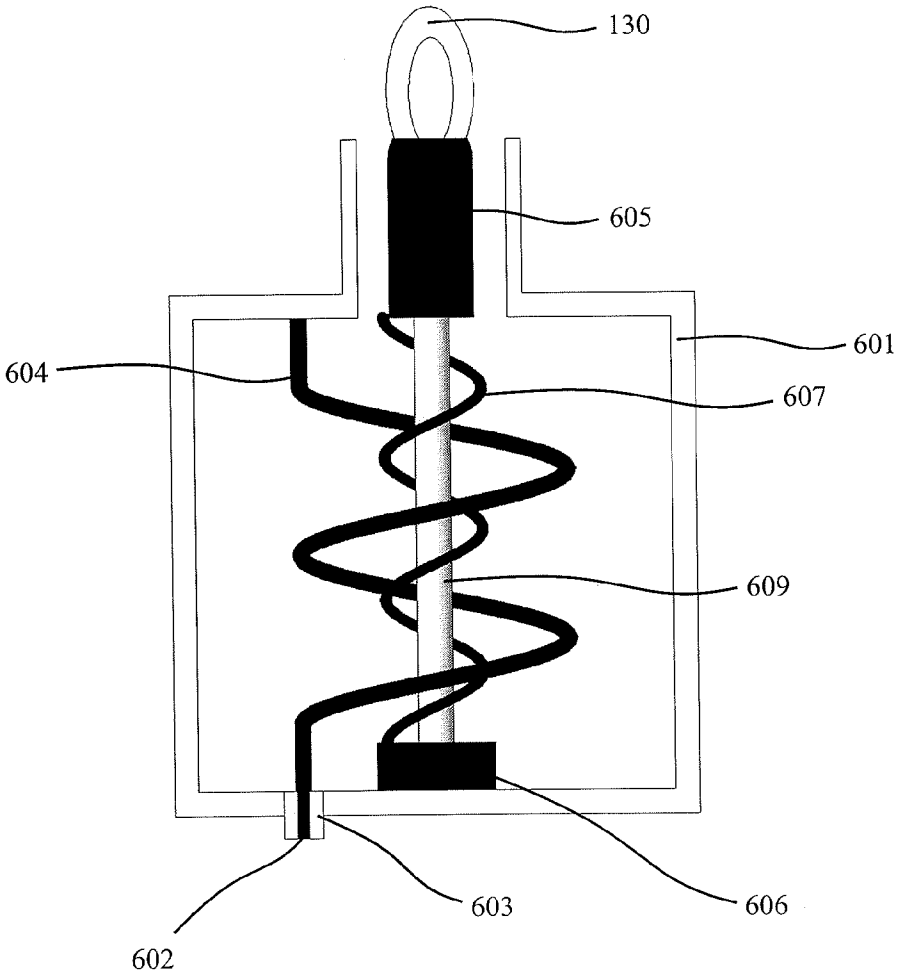
FIG. 6C is a simplified cross section of a coil electrodeless lamp where the output support structure that contains the gas-filled vessel is separated from the grounded support structure by a metal coil element wound around but not touching a non-conductive support structure. It is coupled to a resonator coupling element that is a second coil that surrounds the first coil element according to an embodiment of the present invention.

FIG. 6C illustrates the cross-section for a coil electrodeless plasma lamp according to an embodiment of the present invention. RF Energy is coupled into the resonator enclosure 601 through a standard RF connector 603. A coil resonator coupling element 604 that has one end connected to the RF connector and the other end grounded surrounds the center support structure assembly and directs the RF energy inside the resonator to couple energy to the output support structure comprised of elements 605, 606, 607, and 609. The output support structure is comprised of four elements. The conductive grounded support base 606 provides a physical and electrical connection to the resonator on one end and a connection to the coil element 607 on the other end. The coil element is an electrically conductive material configured into a helical structure to extend through the resonator enclosure. A non-conductive (ceramic) support structure 609 is used to physically support the output support structure 605 and facilitate heat transfer from the gas-filled vessel 130 to the rest of the resonator. It is directly attached to the output support structure 605. The output support structure can be made of any electrically conductive or non-conductive material (ceramic) but must have its surface covered with an electrically conductive layer. The output support structure directs the RF energy that is coupled to it from the resonator coupling element 604 into the gas-filled vessel 130 where light is produced.

Figure 6D:
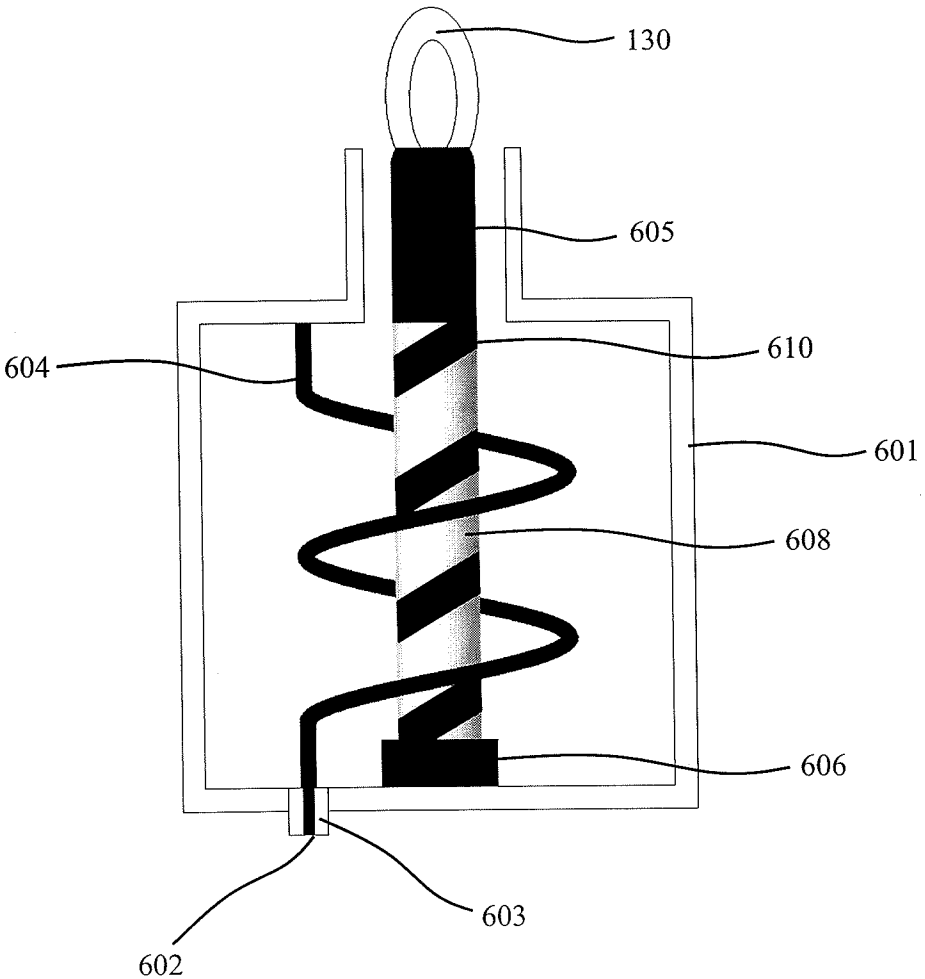
FIG. 6D is a simplified cross section of a coil electrodeless lamp where the output support structure that contains the gas-filled vessel is separated from the grounded support structure by a spiral coil strips attached or painted around a non-conductive support structure. It is coupled to a resonator coupling element that is a coil that surrounds the spiral coil strips according to an embodiment of the present invention.

FIG. 6D illustrates the cross-section for a coil electrodeless plasma lamp according to an embodiment of the present invention. RF Energy is coupled into the resonator enclosure 601 through a standard RF connector 603. A coil resonator coupling element 604 that has one end connected to the RF connector and the other end grounded surrounds the center support structure assembly and directs the RF energy inside the resonator to couple energy to the output support structure comprised of elements 605, 606, 608, and 610. The output support structure is comprised of four elements. The conductive grounded support base 606 provides a physical and electrical connection to the resonator on one end and a connection to the coil element 610 on the other end. The coil element is an electrically conductive material configured in the shape of conductive stripes onto the non-conductive (ceramic) support structure 608 and provides an electrical connection to the output support structure 605. The non-conductive support structure 608 is used to physically support the output support structure 605 and facilitate heat transfer from the gas-filled vessel 130 to the rest of the resonator. It is directly attached to the output support structure 605. The output support structure can be made of any electrically conductive or non-conductive material (ceramic) but must have its surface covered with an electrically conductive layer. The output support structure directs the RF energy that is coupled to it from the resonator coupling element 604 into the gas-filled vessel 130 where light is produced.

FIG. 7A illustrates the cross-section for an electrodeless plasma lamp with a coil resonator coupling element according to an embodiment of the present invention. Energy is coupled into the resonator enclosure 701 through a standard RF connector 703. A coil resonator coupling element 704 that has one end connected to the RF connector and the other end grounded is situated from the connector to the opposite end of the resonator without encircling the output support structure 705. The output support structure is connected to the gas-filled vessel 130 at one end and connected to ground (resonator enclosure) at the other end. The output support structure 705 is used to physically support and facilitate heat transfer from the gas-filled vessel 130 to the rest of the resonator. The output support structure can be made of any electrically conductive or non-conductive material (ceramic) but must have its surface covered with an electrically conductive layer. The output support structure directs the RF energy that is coupled to it from the resonator coupling element 704 into the gas-filled vessel 130 where light is produced.

Figure 7B:
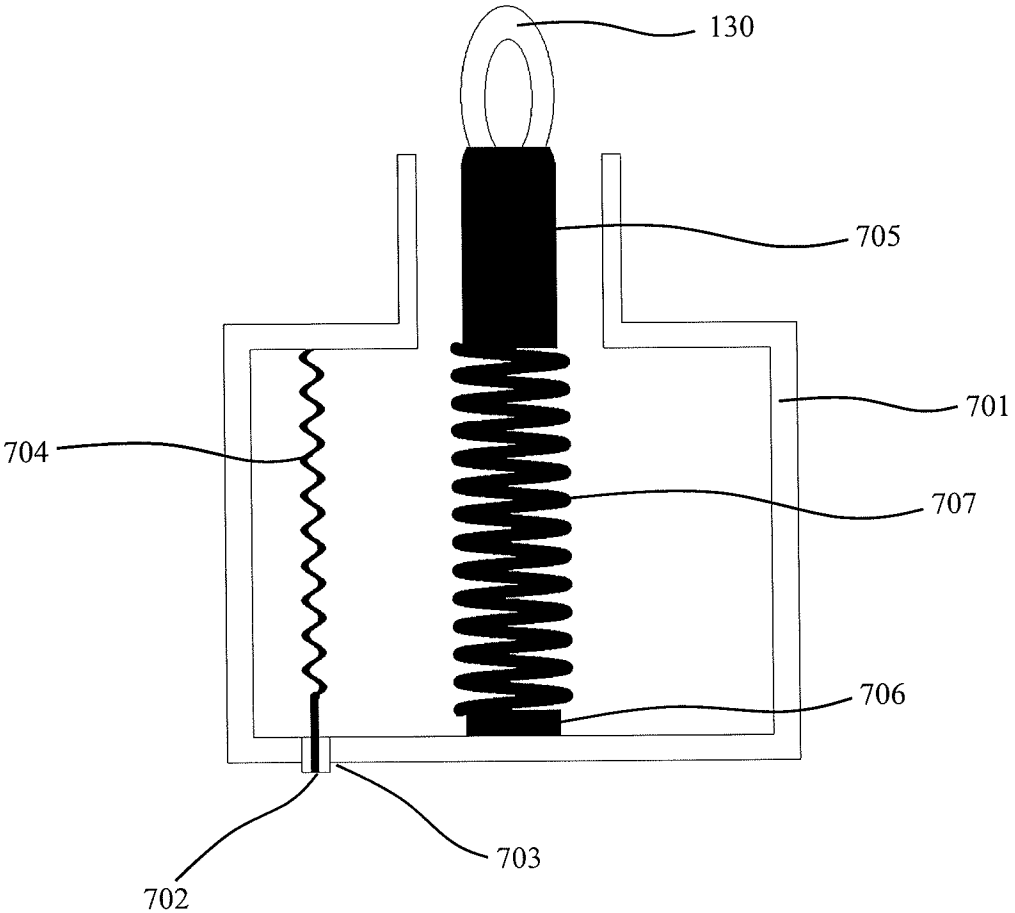
FIG. 7B is a simplified cross section of a coil electrodeless lamp where the resonator coupling element is a coil and is a separated by a gap from the output support structure that is also in the from of a coil according to an embodiment of the present invention.

FIG. 7B is a simplified cross section of a coil electrodeless plasma lamp with a coil resonator coupling element according to an embodiment of the present invention. Energy is coupled into the resonator enclosure 701 through a standard RF connector 703. A coil resonator coupling element 704 that has one end connected to the RF connector and the other end grounded is situated from the connector to the opposite end of the resonator without encircling the output support structure that is also in the form of a coil similar to FIG. 5A. The output support structure is comprised of three elements, 705, 706, and 707. The conductive grounded support base 706 provides a physical and electrical connection to the resonator on one end and a connection to the coil element 707 on the other end. The coil element is an electrically conductive material configured into a helical structure to extend through the resonator enclosure to support and connect to the output support structure 705. The output support structure 705 can be made of any electrically conductive or non-conductive material (ceramic) but must have its surface covered with an electrically conductive layer. The output support structure directs the RF energy that is coupled to it from the resonator coupling element 704 into the gas-filled vessel 130 where light is produced.

Figure 8:
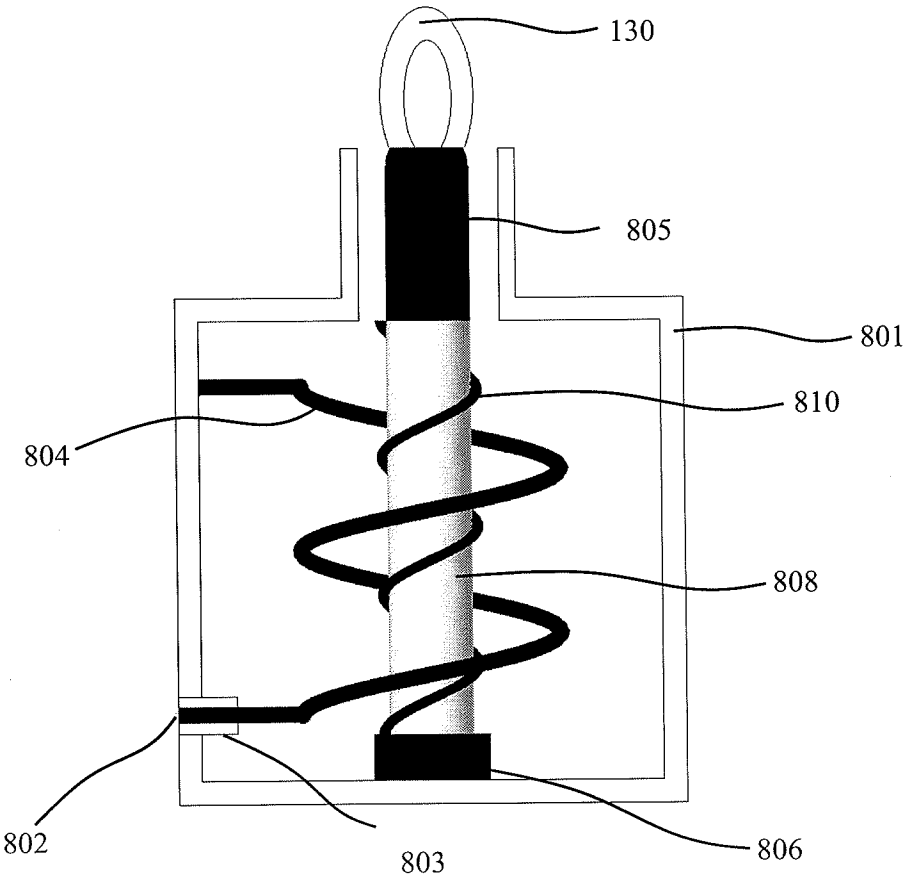
FIG. 8 is a simplified cross section of a coil electrodeless lamp where the output support structure that contains the gas-filled vessel is separated from a grounded support structure by a single metal coil element. It is coupled to a resonator coupling element that is a second coil that surrounds the first coil element. The second coil is fed from the side of the resonator body according to an embodiment of the present invention.

FIG. 8 illustrates the cross-section for a coil electrodeless plasma lamp according to another embodiment of the present invention. Energy from an RF source is directed to the input port 802 of the resonator enclosure 801. In this case, the input is situated on the side of the resonator. RF Energy is coupled into the resonator enclosure 801 through a standard RF connector 803. A coil resonator coupling element 804 that has one end connected to the RF connector and the other end grounded surrounds the output support structure assembly and directs the RF energy inside the resonator to couple the energy to the output support structure comprised of elements 805, 806, 808, and 810. The output support structure is comprised of four elements. The electrically conductive grounded support base 806 provides a physical and electrical connection to the resonator on one end and a connection to the coil element 810 on the other end. The coil element, made from an electrically conductive material, is configured into a helical structure to extend through the resonator enclosure. A non-conductive (ceramic) support structure 808 is used to physically support the coil element 810 and output support structure 805 and facilitate heat transfer from the gas-filled vessel 130 to the rest of the resonator. It is directly attached to the output support structure 805. The output support structure can be made of any electrically conductive or non-conductive material (ceramic) but must have its surface covered with an electrically conductive layer. The output support structure directs the RF energy that is coupled to it from the resonator coupling element 804 into the gas-filled vessel 130 where light is produced.

FIG. 9 illustrates the cross-section for a coil electrodeless plasma lamp according to an embodiment of the present invention. Energy from an RF source is directed to the input port 902 of the resonator enclosure 901. Energy is coupled into the resonator enclosure 901 through a standard RF connector 903. A straight resonator coupling element 904 that has one end connected to the RF connector and the other end grounded, directs the RF energy inside the resonator and couples the energy to the output support structure comprised of elements 905, 906, 907, 908, and 909. The output support structure is comprised of five elements and is similar to the structure illustrated in FIG. 4B. The conductive grounded support base 906 provides a physical and electrical connection to the resonator on one end and a connection to the coil element 907 on the other end. The coil element, made from an electrically conductive material, is configured into a helical structure to extend through the resonator enclosure to support and connect to the output support structure 905. The output support structure 905 is connected to gas-filled vessel 130 at one end and to the coil element 907 and a support post 908 made from a non-conductive material (ceramic) at the other end. The output support structure 905 can be made of any electrically conductive or non-conductive material (ceramic) but must have its surface covered with an electrically conductive layer. An electrically conductive adjustable element 909 is used to tune the resonant frequency by traveling up and down the coil element. The adjustable element must be in electrical contact with the coil element 907. The output support structure directs the RF energy that is coupled to it from the resonator coupling element 904 into the gas-filled vessel 130 where light is produced.

Figure 10:
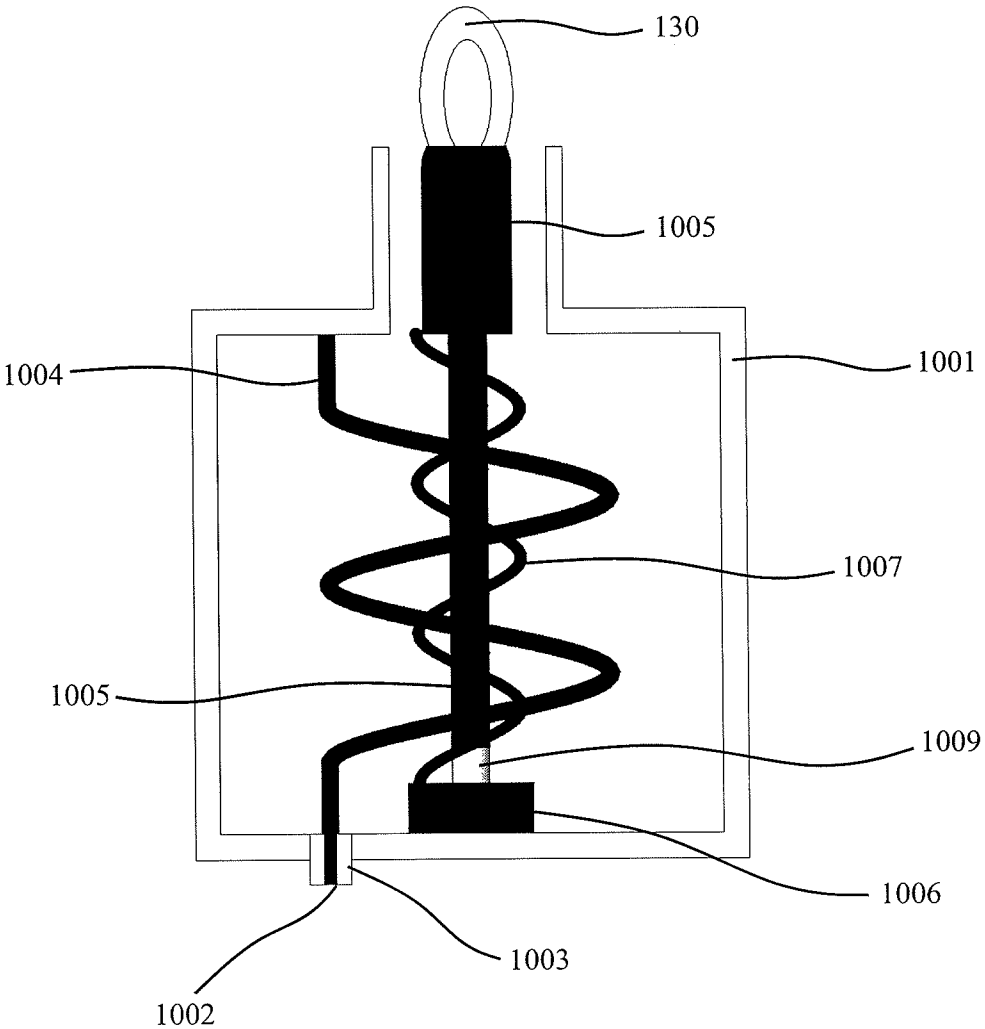
FIG. 10 is a simplified cross section of a coil electrodeless lamp where the output support structure that contains the gas-filled vessel is connected to the grounded support structure by a dielectric post as well as connected to the grounded support structure through the metal coil according to an embodiment of the present invention. It is coupled to a resonator coupling element that is a second coil that surrounds the first coil element.

FIG. 10 illustrates the cross-section for a coil electrodeless plasma lamp according to an embodiment of the present invention. Energy from an RF source is directed to the input port 1002 of the resonator enclosure 1001. Energy is coupled into the resonator enclosure 1001 through a standard RF connector 1003. A coil resonator coupling element 1004 that has one end connected to the RF connector and the other end grounded surrounds the center support structure assembly and directs the RF energy inside the resonator to couple energy to the output support structure comprised of elements 1005, 1006, 1007, and 1009. The output support structure is comprised of four elements. The conductive grounded support base 1006 provides a physical and electrical connection to the resonator on one end and a connection to the coil element 1007 and a non-conductive (ceramic) support structure 1009 on the other end. The coil element is an electrically conductive material configured into a helical structure to extend through the resonator enclosure and is connected at the other end to the top portion of the output support structure 1005. The non-conductive (ceramic) support structure 1009 is used to physically support the output support structure 1005, which in this case has an extended post to the lower portion of the resonator, and to facilitate heat transfer from the gas-filled vessel 130 to the rest of the resonator while providing a DC block. The output support structure can be made of any electrically conductive or non-conductive material (ceramic) but must have its surface covered with an electrically conductive layer. The output support structure directs the RF energy that is coupled to it from the resonator coupling element 1004 into the gas-filled vessel 130 where light is produced.

Figure 11:
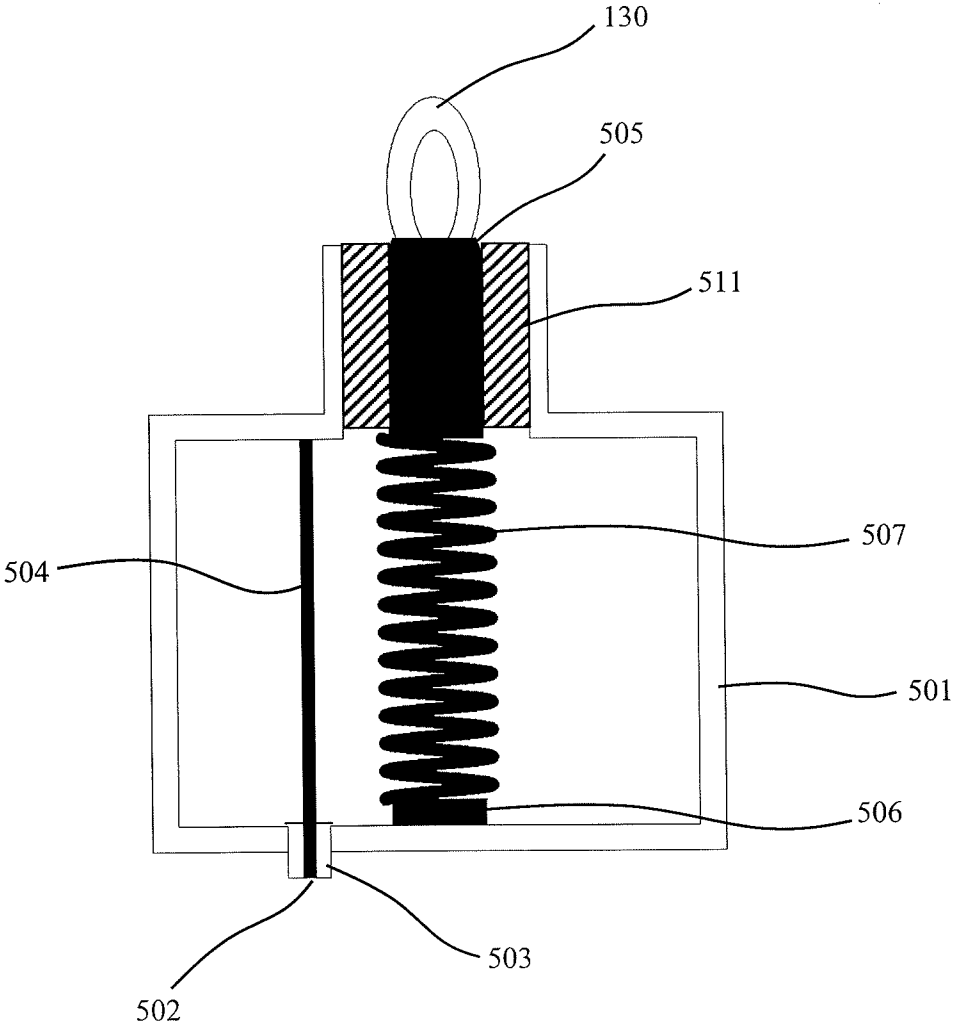
FIG. 11 is a simplified cross section of a coil electrodeless lamp similar to FIG. 5A except that the top section of the resonator around the output support structure is filled with a dielectric material to further lower the resonant frequency of the resonator according to an embodiment of the present invention.

FIG. 11 illustrates the cross-section for a coil electrodeless plasma lamp according to an embodiment of the present invention. This embodiment is similar to the one shown in FIG. 5A except that around the output support structure 505, at the top section of the resonator enclosure 501, is filled with a dielectric material 511 (for example quartz or alumina) to further lower the resonant frequency of the resonator. It is also possible to partially or completely fill the bottom portion of enclosure 501 with a dielectric material as well.

While the above is a full description of the specific embodiments, various modifications, alternative constructions and equivalents may be used. As used herein, the term "coil" may include regularly spaced windings or irregularly spaced windings, as well as spiral, rectangular, helical, annular, polygon, or any combination of these, and others that would be understood by one of ordinary skill in the art. Additionally, the terms "input coupling" and "output coupling" have been used in the above embodiments, but such terms can be described more generally as a resonator coupling element, an RF coupling element, or such terms as support structure(s) and combinations, as well as other well known ordinary meanings. Therefore, the above description and illustrations should not be taken as limiting the scope of the present invention which is defined by the appended claims.

What is claimed is:

1. A plasma lamp apparatus comprising:

a post structure comprising a material overlying a surface region of the post structure, the post structure having a first end and a second end;

an output support structure provided on the first end of the post structure;

a helical coil structure operably configured along one or more portions of the post structure;

a bulb device comprising a first portion and a second portion spaced from the first portion, the first portion of the bulb device being configured to the output support structure provided on the first end of the post structure; and a resonator coupling element configured to feed radio frequency energy to at least the helical coil structure and to cause the bulb device to emit electromagnetic radiation.

2. The apparatus of claim 1 wherein the material overlying the surface region of the post structure is selected from a dielectric material or a metal material; wherein the output support structure comprises a recessed region to hold the bulb device; wherein the output support structure comprises a ceramic material to facilitate thermal energy away from the bulb device.

3. The apparatus of claim 1 wherein the post structure comprises a metal material.

4. The apparatus of claim 1 wherein the post structure comprises a dielectric material.

5. The apparatus of claim 1 wherein the post structure comprises a first structure and a second structure and an air gap provided between the first structure and the second structure, wherein the helical coil structure is disposed between the first structure and the second structure within the air gap.

6. The apparatus of claim 1 wherein the helical coil structure circumvents the post structure.

7. The apparatus of claim 1 further comprising a housing to encase the post structure, helical coil, and resonator coupling element.

8. The apparatus of claim 1 wherein the helical coil structure comprises a metal material and further comprising a ground potential coupled to the second end of the post structure.

9. The apparatus of claim 1 wherein the helical coil structure comprises a metal material, the metal material is selected from at least an aluminum, brass, copper, gold, or silver.

10. The apparatus of claim 1 wherein the helical coil structure is characterized by a resistivity of 9×10^-7 ohms/square and less.

11. The apparatus of claim 1 wherein the helical coil structure comprises at least one winding or a portion of a winding.

12. The apparatus of claim 1 wherein the helical coil structure comprises more than 1 winding, including any portions thereof.

13. The apparatus of claim 1 wherein the helical coil structure is configured to increase an inductance of a resonator structure, the resonator structure including at least a housing, the resonator coupling element, and the post structure.

14. The apparatus of claim 1 wherein the helical coil structure is configured to increase an inductance of a resonator structure, the resonator structure including at least a housing and the post structure, the increase in inductance being about 50% to about 1000% of the resonator structure.

15. The apparatus of claim 1 wherein the radio frequency energy ranges from about 100 kHz to about 10 GHz.

16. The apparatus of claim 1 wherein the helical coil structure comprises a painted helical pattern on a dielectric core.

17. The apparatus of claim 1 further comprising a tunable metal inset provided within a region inside a length of the helical coil structure to allow tuning of an inductance.

18. The apparatus of claim 1 wherein the post structure comprises a dielectric core along a length of the helical coil structure to transfer of heat from the bulb to a heat sink.

19. The apparatus of claim 18 wherein the dielectric core comprises of a ceramic material, the ceramic material comprising alumina.

20. A plasma lamp apparatus comprising:

a support structure having a first end and a second end;

a coil structure configured along one or more portions of the support structure;

a bulb device configured to the first end of the support structure;

a ground potential coupled to the second end of the support structure;

a coupling element configured to feed at least radio frequency energy to at least the coil structure and to cause the bulb device to emit electromagnetic radiation; and a housing configured to enclose the support structure, coil structure, and coupling element, the bulb device being disposed outside the housing.

* * * * *